US007973809B2

(12) United States Patent
Hosaka et al.

(10) Patent No.: US 7,973,809 B2
(45) Date of Patent: Jul. 5, 2011

(54) ELECTRO-OPTICAL DEVICE, DRIVING CIRCUIT AND DRIVING METHOD OF THE SAME, AND ELECTRONIC APPARATUS

(75) Inventors: Hiroyuki Hosaka, Matsumoto (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 722 days.

(21) Appl. No.: 12/107,237

(22) Filed: Apr. 22, 2008

(65) Prior Publication Data

US 2008/0278468 A1 Nov. 13, 2008

(30) Foreign Application Priority Data

May 11, 2007 (JP) ..... 2007-126551

(51) Int. Cl.
*G09G 3/36* (2006.01)

(52) U.S. Cl. ..... 345/690; 345/691; 345/692; 345/204; 345/63; 345/76; 345/77; 345/82; 345/87; 345/89

(58) Field of Classification Search ..... None
See application file for complete search history.

(56) References Cited

U.S. PATENT DOCUMENTS

| | | | | |
|---|---|---|---|---|
| 7,322,095 | B2 | 1/2008 | Guan et al. | |
| 7,479,972 | B2 * | 1/2009 | Takai | 345/690 |
| 2005/0057852 | A1 | 3/2005 | Yazawa et al. | |
| 2005/0141137 | A1 | 6/2005 | Okada et al. | |
| 2006/0245108 | A1 | 11/2006 | Hsu et al. | |

FOREIGN PATENT DOCUMENTS

| | | |
|---|---|---|
| JP | A 2003-114661 | 4/2003 |
| JP | A-2005-92929 | 4/2005 |
| JP | A-2005-174449 | 6/2005 |
| JP | A-2005-109518 | 7/2005 |
| JP | A-2005-310363 | 11/2005 |
| JP | A-2006-309930 | 11/2006 |

* cited by examiner

*Primary Examiner* — Bipin Shalwala
*Assistant Examiner* — Kelly Hegarty
(74) *Attorney, Agent, or Firm* — Oliff & Berridge, PLC

(57) ABSTRACT

A driving circuit of an electro-optical device wherein one field is divided into p (p is an integer that is equal to or more than two) groups and each group is divided into two sub-fields. The p groups each are set to have the length of a time period that is equal to one another. The 2p sub-fields that constitute the one field are set to different lengths of time periods in such a manner that a boundary between two sub-fields of each group is shifted by a predetermined interval compared to the boundary between the two sub-fields of the preceding group. The different gray scale values are expressed by turning on a single sub-field or n (n is an integral number that is equal to two or more and that is equal to or less than 2p) sub-fields that are adjacent to each other.

9 Claims, 23 Drawing Sheets

<CONFIGURATION OF FIELD>

<CONFIGURATION OF FIELD>

FIG. 5

30

| | | SUB-FIELD | | | | | | | |
|---|---|---|---|---|---|---|---|---|---|
| | | sf1 | sf2 | sf3 | sf4 | sf5 | sf6 | sf7 | sf8 |
| GRAY-SCALE LEVEL | 0 | 0 | 0 | 0 | 0 | 0 | 0 | 0 | 0 |
| | 1 | 1 | 0 | 0 | 0 | 0 | 0 | 0 | 0 |
| | 2 | 0 | 0 | 1 | 0 | 0 | 0 | 0 | 0 |
| | 3 | 0 | 0 | 0 | 0 | 1 | 0 | 0 | 0 |
| | 4 | 0 | 0 | 0 | 0 | 0 | 0 | 1 | 0 |
| | 5 | 0 | 0 | 0 | 0 | 0 | 0 | 0 | 1 |
| | 6 | 0 | 0 | 0 | 0 | 0 | 1 | 0 | 0 |
| | 7 | 0 | 0 | 0 | 1 | 0 | 0 | 0 | 0 |
| | 8 | 0 | 1 | 0 | 0 | 0 | 0 | 0 | 0 |
| | 9 | 1 | 1 | 0 | 0 | 0 | 0 | 0 | 0 |
| | 10 | 1 | 0 | 0 | 0 | 0 | 0 | 1 | 1 |
| | 11 | 1 | 1 | 1 | 0 | 0 | 0 | 0 | 0 |
| | 12 | 0 | 0 | 1 | 1 | 1 | 0 | 0 | 0 |
| | 13 | 0 | 0 | 0 | 0 | 1 | 1 | 1 | 0 |
| | 14 | 1 | 1 | 0 | 0 | 0 | 0 | 0 | 1 |
| | 15 | 0 | 0 | 0 | 0 | 0 | 1 | 1 | 1 |
| | 16 | 0 | 0 | 0 | 1 | 1 | 1 | 0 | 0 |
| | 17 | 0 | 1 | 1 | 1 | 0 | 0 | 0 | 0 |
| | 18 | 0 | 0 | 0 | 0 | 1 | 1 | 1 | 1 |
| | 19 | 1 | 0 | 0 | 0 | 1 | 1 | 1 | 1 |
| | 20 | 1 | 1 | 1 | 0 | 0 | 0 | 1 | 1 |
| | 21 | 1 | 1 | 1 | 1 | 1 | 0 | 0 | 0 |
| | 22 | 0 | 0 | 1 | 1 | 1 | 1 | 1 | 0 |
| | 23 | 1 | 1 | 1 | 1 | 0 | 0 | 0 | 1 |
| | 24 | 1 | 1 | 0 | 0 | 0 | 1 | 1 | 1 |
| | 25 | 0 | 0 | 0 | 1 | 1 | 1 | 1 | 1 |
| | 26 | 0 | 1 | 1 | 1 | 1 | 1 | 0 | 0 |
| | 27 | 0 | 0 | 1 | 1 | 1 | 1 | 1 | 1 |
| | 28 | 1 | 0 | 1 | 1 | 1 | 1 | 1 | 1 |
| | 29 | 1 | 1 | 1 | 0 | 1 | 1 | 1 | 1 |
| | 30 | 1 | 1 | 1 | 1 | 1 | 0 | 1 | 1 |
| | 31 | 1 | 1 | 1 | 1 | 1 | 1 | 1 | 0 |
| | 32 | 1 | 1 | 1 | 1 | 1 | 1 | 0 | 1 |
| | 33 | 1 | 1 | 1 | 1 | 0 | 1 | 1 | 1 |
| | 34 | 1 | 1 | 0 | 1 | 1 | 1 | 1 | 1 |
| | 35 | 0 | 1 | 1 | 1 | 1 | 1 | 1 | 1 |
| | 36 | 1 | 1 | 1 | 1 | 1 | 1 | 1 | 1 |

<CONFIGURATION OF FIELD>

ELECTRO-OPTICAL DEVICE, DRIVING CIRCUIT AND DRIVING METHOD OF THE SAME, AND ELECTRONIC APPARATUS

BACKGROUND

1. Technical Field

The present invention relates to a technology for making a display element perform grayshade in such a manner that one field is divided into a plurality of sub-fields and then the display element is made into an on state or an off state in each of the sub-fields.

2. Related Art

When the grayshade is performed in an electro-optical device that uses display elements, such as liquid crystal elements, as pixels, the following technology has been proposed as a substitute for a voltage modulation method. That is, there has been proposed a technology for performing grayshade in such a manner that one field is divided into a plurality of sub-fields and then the pixels (liquid crystal elements) are made into an on state or an off state in each sub-field to thereby change the percentage of a time period during which the pixels are made into an on state or an off state within the one field, which is described in JP-A-2003-114661. Moreover, in the above technology, using the feature that the response speed of the liquid crystal elements is relatively slow, that is, specifically, using the feature that, even when the liquid crystal elements are made into an on state in only one sub-field, the transmittance ratio or reflectance ratio of each liquid crystal element does not reach black color that corresponds to an on state (is not saturated), the transmittance ratio or reflectance ratio of each liquid crystal element is minutely controlled in each of the sub-fields.

For example, in the above technology, fragmentation of gray scales from a basic m gray scale to a basic (m+1) gray scale is achieved in such a manner that, in the first sub-field, located on the preceding side of one field, to the (m+1)th sub-field in terms of time, sub-fields, in which the liquid crystal elements are made to enter an off state, are appropriately arranged (which is described in JP-A-2003-114661 and, specifically, shown in FIG. 16). More specifically, between the case in which the sub-fields, in which the liquid crystal elements are made to enter an off state, are arranged on the preceding side of one field in terms of time and the case in which the sub-fields, in which the liquid crystal elements are made to enter an off state, are arranged on the following side of the one field in terms of time, the transmittance ratio or reflectance ratio of the liquid crystal elements is closer to the saturation side in the latter case than in the former case. Thus, the brightness close to the basic (m+1) gray scale may be achieved.

Incidentally, the response speed of the liquid crystal generally increases as the temperature rises. Therefore, when the temperature of each display element is high and then the response speed has been increased, between the case in which the sub-fields, in which the liquid crystal elements are made to enter an off state, are arranged on the preceding side of one field in terms of time and the case in which the sub-fields, in which the liquid crystal elements are made to enter an off state, are arranged on the following side of the one field in terms of time, such an inconvenience that there is no difference in brightness of the display elements and thereby an appropriate gray scale display cannot be performed may be conceived. In addition, in the above technology, the scanning lines are selected in the order from the first line; however, in this configuration, the length of a time period of each sub-field needs to be set longer than time required to select all the scanning lines. Because the number of addressable luminance levels that can be displayed is determined by the length of a time period of the sub-field that is set the shortest, there is a problem that, when the length of a time period of each sub-field cannot be made short, the number of addressable luminance levels that can be displayed is limited.

SUMMARY

An advantage of some aspects of the invention is that it provides an electro-optical device that is capable of appropriately displaying gray scales even when the response speed varies because of the temperature, or the like, and that is able to easily increase the number of addressable luminance levels that can be displayed, and also provides a driving circuit of the electro-optical device, a method of driving the electro-optical device and an electronic apparatus.

Such an inconvenience that the response speed of the display element varies because of temperature, or the like, and thereby an appropriate gray scale display cannot be performed is caused by discontinuous sub-fields in which the pixels are made to enter an on state or an off state. In addition, in order to remove the necessity of selecting all the scanning lines within a sub-field, it is only necessary to employ so-called region scanning driving. An aspect of the invention provides a driving circuit of an electro-optical device that includes a plurality of scanning lines, a plurality of data lines and a plurality of pixels arranged at positions corresponding to intersections of the scanning lines and the data lines. The driving circuit includes a scanning line driving circuit that drives the plurality of scanning lines and a data line driving circuit that drives the plurality of data lines. One field is divided into p (p is an integer that is equal to or more than two) groups and then each group is divided into two sub-fields. The p groups each are set to have the length of a time period that is equal to one another. The lengths of time periods of the 2p sub-fields that constitute the one field are set to be different from one another in such a manner that a boundary of two sub-fields that constitute each group is set to a point that is sequentially shifted to any one of the preceding side or following side along time axis by a predetermined interval for each of the p groups. The total length of time periods of the sub-fields that are made to enter an on state within the one field is set in accordance with a gray-scale level that is specified to each of the pixels. A gray-scale level at which, when viewed in one or adjacent fields, the sub-fields that are made to enter an on state or an off state are continuous, respectively, is included in the number of addressable luminance levels that can be displayed in each of the pixels. The scanning line driving circuit has stages corresponding to the plurality of scanning lines. The scanning line driving circuit includes a shift register and logic circuits. The shift register sequentially delays a pulse, which is supplied at a time interval corresponding to each of the sub-fields, over the stages in accordance with a clock signal. Each of the logic circuits is provided for the plurality of scanning lines and supplies the corresponding scanning line with a pulse that is overlappingly output from the stages of the shift register as a scanning signal that indicates selection so as not to overlap each other among the plurality of lines through logical operation. The data line driving circuit, when one of the scanning lines is selected, in terms of a gray scale of the pixel corresponding to the selected one of the scanning lines and one of the data lines, supplies a data signal to the one of the data lines in accordance with an on state or an off state that is set to a sub-field corresponding to the selection. According to the aspect of the invention, it is possible to remove an inconvenience that, when the sub-fields in which the liquid crystal elements are made to enter an on state or an off state are discontinuous, the pixels do not exhibit desired brightness. Furthermore, owing to the region scanning driving, it is not necessary to select all the scanning lines within a period of the sub-field that is set the shortest and, hence, there will be no such a problem that the number of addressable luminance levels that can be displayed is limited.

In the aspect of the invention, the driving circuit may be configured so that the number of pulses that are overlappingly output from the stages of the shift register is up to "2", wherein the logic circuit provided in each line outputs a logical multiplication signal of an enable signal and the shift register, and wherein different enable signals are output between in the odd-numbered lines and in the even-numbered lines. This is the configuration when the driving circuit according to the aspect of the invention is the simplest. In addition, in the aspect of the invention, the driving circuit may be configured so that the boundary between the two sub-fields that constitute each group is set to a point that is sequentially shifted to the following side along time axis by a predetermined interval for the p groups, wherein the scanning line driving circuit includes a circuit that supplies a pulse output at time intervals of the length of a time period of one of the groups to the shift register as it is in order to select scanning lines in a preceding sub-field in terms of time in the one of the groups, and that delays a pulse output at time intervals of the length of the time period of the one of the groups in accordance with the length of a time period of the preceding sub-field in terms of time in the one of the groups and then supplies the delayed pulse to the shift register in order to select scanning lines in a following sub-field in terms of time. In the above configuration, for selection of scanning lines in the preceding sub-field in terms of time, a pulse that is output at time intervals of the length of a time period of a group is used as it is for the transfer in the shift register, while, for selection of scanning lines in the following sub-field in terms of time, a pulse that is output at time intervals of the length of a time period of the group and is delayed is used for the transfer in the shift register. Thus, it is possible to simplify the configuration.

In the aspect of the invention, the driving circuit may be configured so that each of the pixels includes a liquid crystal element that appears any one of white color or black color when in the on state and that appears the other one of white color or black color when in the off state, wherein, among the sub-fields, the length of a time period of the shortest sub-field is set shorter than saturation response time that takes until the reflectance ratio or transmittance ratio of the liquid crystal element is saturated when a voltage for the on state is applied to the liquid crystal element. In this manner, in the aspect of the invention, the length of a time period of the shortest sub-field need not be dependent on selection of the scanning line or saturation response time of the liquid crystal element.

In the aspect of the invention, because each of the pixels needs to enter an on state or an off state every sub-field, the driving circuit may be configured so that the number of gray-scale levels in which, when viewed in one or adjacent fields, the sub-fields in which the liquid crystal elements are made to enter an on state or an off state are continuous, respectively, is equal to or more than half the number of addressable luminance levels that can be displayed in the pixels, wherein the driving circuit further includes a conversion table that converts display data, which specify a gray-scale level of each pixel, into data that specify an on state or an off state that is set in units of sub-field, and wherein the data line driving circuit outputs a data signal on the basis of the converted data. In addition, in the aspect of the invention, the driving circuit may be configured so that, in the sub-field, each of the pixels is controlled to any one of the on state, the off state or an intermediate state that falls between the on state and the off state. Thus, when an intermediate state is further added in addition to two states, that is, an on state and an off state, it is possible to increase the number of addressable luminance levels that can be displayed without changing the array of sub-fields. Then, the plurality of intermediate states, equal to or more than two (somewhat bright, somewhat dark, or the like), may be employed. Note that the aspects of the invention are not limited to the driving circuit of the electro-optical device, but they may be applied to a method of driving the electro-optical device, the electro-optical device itself, and, moreover, an electronic apparatus that is provided with the electro-optical device.

BRIEF DESCRIPTION OF THE DRAWINGS

The invention will be described with reference to the accompanying drawings, wherein like numbers reference like elements.

FIG. 5 is a view that shows the on-off conversion of each sub-field in the electro-optical device.

DESCRIPTION OF EXEMPLARY EMBODIMENTS

Embodiments of the invention will now be described with reference to the accompanying drawings.

First Embodiment

Figure 1:
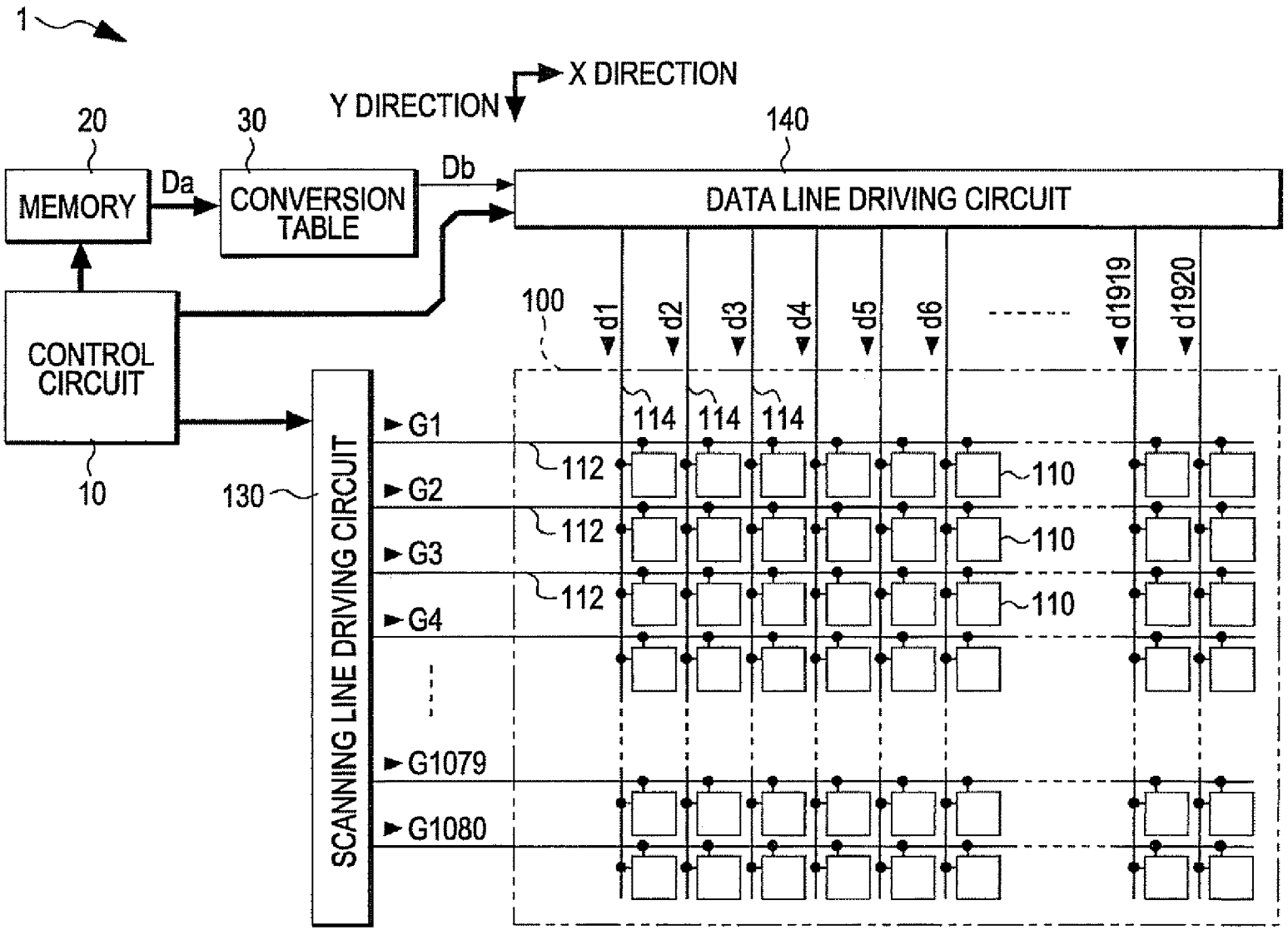
FIG. 1 is a view that shows the overall configuration of an electro-optical device according to a first embodiment of the invention.

First, a first embodiment of the invention will be described. FIG. 1 is a block diagram that shows the overall configuration of an electro-optical device 1 according to the first embodiment. As shown in the drawing, the electro-optical device 1 roughly includes a control circuit 10, a memory 20, a conversion table 30, a display circuit 100, a scanning line driving circuit 130 and a data line driving circuit 140. The control circuit 10 controls portions of the electro-optical device 1, as will be described later. The display circuit 100 includes pixels that are arranged in a matrix. Specifically, the display circuit 100 includes 1080 scanning lines 112 that extend in an X (horizontal) direction in the drawing and 1920 data lines 114 that are electrically insulated from the scanning lines 112 and that extend in a Y (vertical) direction in the drawing. Then, the pixels 110 are provided at portions corresponding to intersections of the scanning lines 112 and the data lines 114. Thus, in the present embodiment, the pixels 110 are arranged in the display circuit 100 in a matrix of 1080 rows by 1920 columns; however, the aspects of the invention are not intended to be limited to this arrangement.

The memory 20 includes storage areas that correspond to the pixels arranged in 1080 rows by 1920 columns. Each of the storage areas stores the display data Da of a corresponding one of the pixels 110. Each piece of the display data Da specifies the brightness (gray-scale level) of the pixel 110 and, in the present embodiment, specifies the gray-scale level from "0" to "36" in steps of one level. Note that the display data Da are supplied from an upper level device (not shown) and are stored in the storage area corresponding to the pixel by the control circuit 10, while, on the other hand, the data corresponding to the pixel that is scanned by the display circuit 100 are read out from the memory 20. The conversion table 30 converts the display data Da, which have been read out from the memory 20, to data Db that indicate whether to turn on or off the pixel 110 (liquid crystal element) in accordance with the gray-scale level specified by the display data Da and the sub-field in which the pixel 110 is driven. Note that the above conversion will be described later.

Configuration of Pixels

Figure 2:
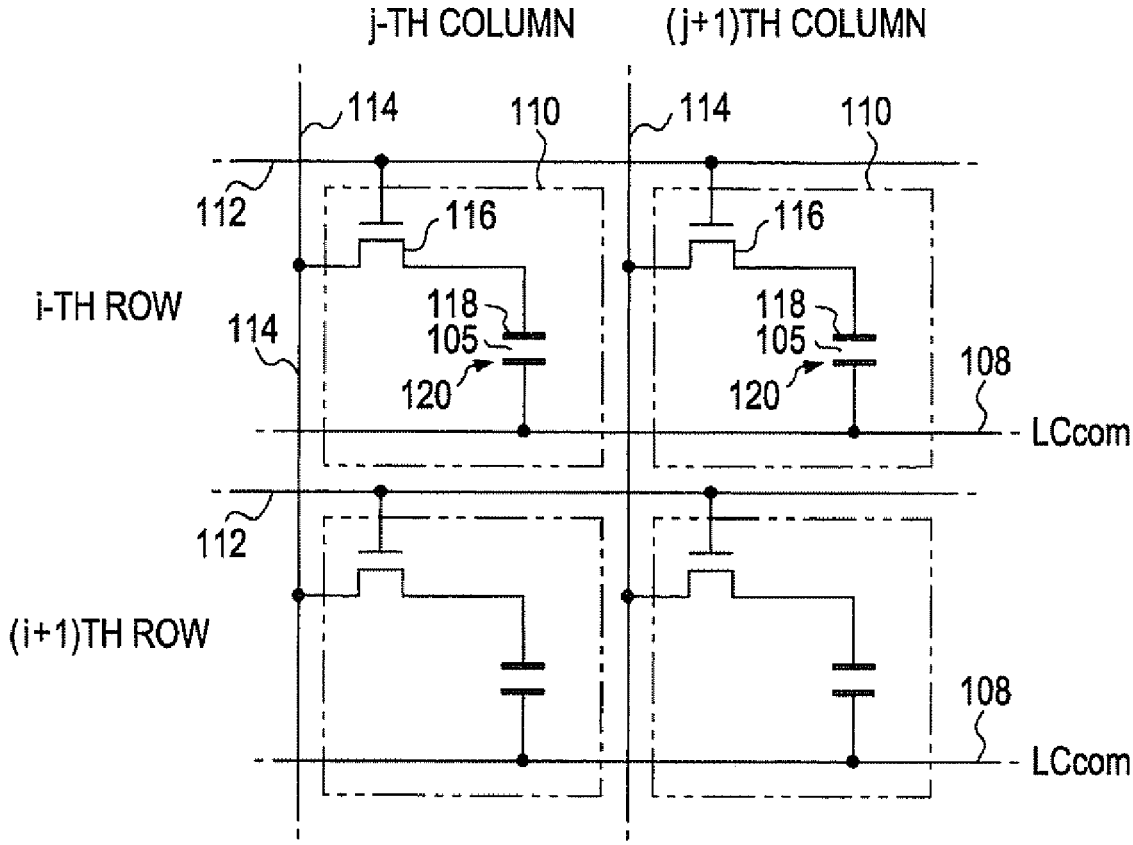
FIG. 2 is a view that shows the configuration of pixels in the electro-optical device.

For easier description, the configuration of the pixels 110 will be described with reference to FIG. 2. FIG. 2 is a view that shows the detailed configuration of the pixels 110, showing the configuration of two by two, that is, four pixels in total, arranged at portions corresponding to intersections of the i-th row or the adjacent (i+1)th row and the j-th column or the adjacent (j+1)th column. Here, and (i+1) are symbols that generally indicate a row in which the pixels 110 are arranged and, in the present embodiment, are integers, each of which ranges from 1 to 1080. In addition, j and (j+1) are symbols that generally indicate a column in which the pixels 110 are arranged and are integers, each of which ranges from 1 to 1920.

As shown in FIG. 2, each of the pixels 110 includes an n-channel transistor (MOSFET) 116 and a liquid crystal element 120. Here, because each of the pixels 110 has the same configuration, the description will be made representatively using the pixel 110 located at the i-th row and j-th column. In the i-th row and j-th column pixel 110, the gate electrode of the transistor 116 is connected to the i-th scanning line 112, while the source electrode thereof is connected to the j-th column data line 114 and the drain electrode thereof is connected to a pixel electrode 118, which is one end of the liquid crystal element 120. In addition, the other end of the liquid crystal element 120 is an opposite electrode 108. The opposite electrode 108 is common to all the pixels 110 and, in the present embodiment, is maintained at a voltage LCcom.

The display circuit 100 includes an element substrate, an opposite substrate and a liquid crystal 105. The scanning lines 112, the data lines 114, the transistors 116, the pixel electrodes 118, and the like, are formed on the element substrate. The opposite electrode 108 is formed on the opposite substrate. The element substrate and the opposite substrate are spaced at a certain gap in between, and are adhered so that electrode forming faces of both substrates are opposite each other. The liquid crystal 105 is sealed in the gap. The above configuration is not shown in the drawing. Therefore, in the present embodiment, the liquid crystal element 120 is configured so that the pixel electrodes 118 and the opposite electrode 108 hold the liquid crystal 105. Note that, in the present embodiment, the liquid crystal element 120 is of a reflective LCOS (Liquid Crystal on Silicon) type in which the element substrate uses a semiconductor substrate and the opposite substrate uses a transparent substrate, such as glass. Therefore, on the element substrate, in addition to the scanning line driving circuit 130 and the data line driving circuit 140, the control circuit 10, the memory 20 and the conversion table 30 all may be formed.

In the above configuration, when the transistor 116 is made to enter an on state (conductive state) by applying a selection voltage to the scanning line 112 and a data signal is supplied to the pixel electrode 118 through the data line 114 and the transistor 116, which is in an on state, a voltage difference between the voltage of the data signal and the voltage LCcom applied to the opposite electrode 108 is written to the liquid crystal element 120 that is located at a position corresponding to the intersection of the scanning line 112, to which the selection voltage is applied, and the data line 114, to which the data signal is supplied. Note that, as the scanning line 112 attains a non-selection voltage, the transistor 116 enters an off (non-conductive) state; however, in the liquid crystal element 120, the voltage that has been written at the time when the transistor 116 enters a conductive state is held by its capacitive property.

In the present embodiment, the liquid crystal element 120 is set to a normally black mode. Therefore, the reflectance ratio (transmittance ratio in the case of transmissive type) of the liquid crystal element 120 becomes smaller as the effective value of a voltage difference between the pixel electrode 118 and the opposite electrode 108 decreases. In a state where no voltage is applied, the liquid crystal element 120 substantially appears black color. However, in the present embodiment, only any one of an on voltage that sets the above voltage difference equal to or higher than a saturation voltage and an off voltage that is equal to or lower than a threshold value is applied to the pixel electrode 118. In the normally black mode, when the reflectance ratio in the darkest state is defined as a relative reflectance ratio 0% and the reflectance ratio in the brightest state is defined as a relative reflectance ratio 100%, within the voltage applied to the liquid crystal element 120, a voltage of which the relative reflectance ratio is 10% is an optical threshold voltage and a voltage of which the relative reflectance ratio is 90% is an optical saturation voltage. In the voltage modulation method (analog driving), it is designed so that, when the liquid crystal element 120 is made to appear a halftone (gray color), a voltage that is equal to or lower than the optical saturation voltage is applied to the liquid crystal 105. For this reason, the reflectance ratio of the liquid crystal 105 is a value that is substantially proportional to a voltage applied to the liquid crystal 105. In contrast, in the present embodiment, grayshade is performed by applying only one of an on voltage or an off voltage to the pixel electrode 118 in the following manner. Specifically, in the present embodiment, the grayshade is executed in such a manner that one field is divided into a plurality of sub-fields and then a time period during which an on voltage is applied to the pixel electrode 118 to make the liquid crystal element 120 enter an on state and a time period during which an off voltage is applied to the pixel electrode 118 to make the liquid crystal element 120 enter an off state are distributed in units of sub-field and controlled. In the present embodiment, the voltage used as an on voltage employs a voltage that sets a voltage difference to about 1 to 1.5 times as high as the saturation voltage. This is because the rising of the response characteristics of the liquid crystal is substantially proportional to a voltage level applied to the liquid crystal element and, therefore, it is desirable to improve the response characteristics of the liquid crystal. In addition, the voltage used as an off voltage employs a voltage that sets a voltage difference equal to or lower than the optical threshold voltage.

Configuration of Field

In the present embodiment as described above, the grayshade is executed in such a manner that a time period during which the liquid crystal elements 120 are made into an on state or an off state is distributed in units of sub-field and controlled. Then, first, the configuration of a field in the present embodiment will be described.

Figure 3:
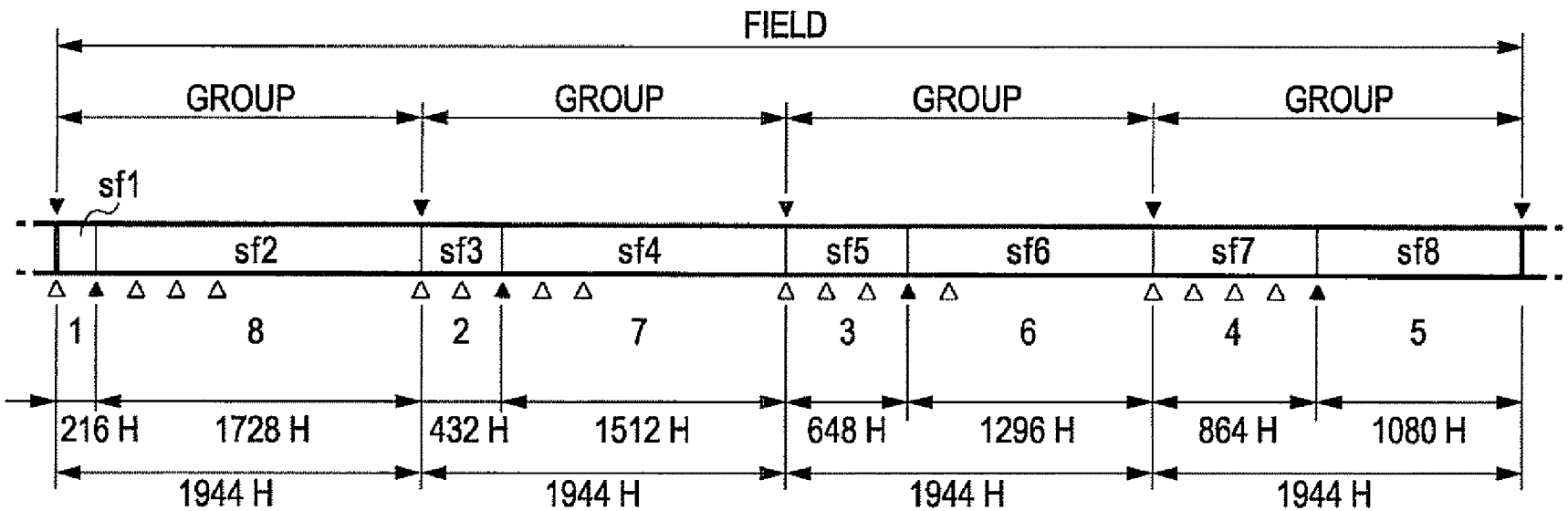
FIG. 3 is a view that shows the configuration of a field used in the electro-optical device.

FIG. 3 is a view that shows the configuration of a field. In the drawing, one field means a time period that is necessary to form one image. One field is fixed and has a constant period of 16.7 milliseconds (which corresponds to one frequency of 60 Hz). One field means the same as a frame in a non-interlaced method. As shown in the drawing, in the present embodiment, a time period of one field is equally divided into four groups and, furthermore, each group is divided into two sub-fields. Therefore, one field is divided into eight sub-fields in total; however, for the sake of convenience, the sub-fields are termed as sf1, sf2, sf3, . . . , sf8 in the order from the first sub-field in the one field.

Here, where one cycle of a clock signal Cly, which will be described later, is denoted as 1H, the length of a time period of each group is 1944H and, therefore, the length of a time period of one field is 7776(=1944×4)H In addition, the lengths of time periods of the sub-fields sf1, sf2, sf3, sf4, sf5, sf6, sf7 and sf8 are respectively set to 216H, 1728H, 432H, 1512H, 648H, 1296H, 864H and 1080H. Thus, when the ratio of the length of the time period of the sub-field sf1 is set for "1", the ratio of the length of a time period of one field is "36", and the ratios of the lengths of the time periods of the sub-fields sf2, sf3, sf4, sf5, sf6, sf7 and sf8 are respectively "8", "2", "7", "3", "6", "4" and "5".

In addition, the length of a time period of a group consisting of the sub-fields sf1 and sf2, the length of a time period of a group consisting of the sub-fields sf3 and sf4, the length of a time period of a group consisting of the sub-fields sf5 and sf6 and the length of a time period of a group consisting of the sub-fields sf7 and sf8 all are 1944H and each have a ratio of "9". Thus, the length of the time period of each group is the same among all the groups. Here, the start timing of each of the odd-numbered sub-fields sf1, sf3, sf5 and sf7 is the leading timing of each of the groups into which the time period of one field is divided into four. In contrast, the start timings of the even-numbered sub-fields sf2, sf4, sf6 and sf8 are timings that are respectively delayed sequentially by 216H, 432H, 648H and 864H from the start timings of the odd-numbered sub-fields sf1, sf3, sf5 and sf7, that is, timings that are respectively delayed by the ratios of "1", "2", "3" and "4". In addition, the fields are continuous in terms of time and, therefore, the sub-field sf8 of a field adjoins the sub-field sf1 of the next field.

Grayshade

Figure 4:
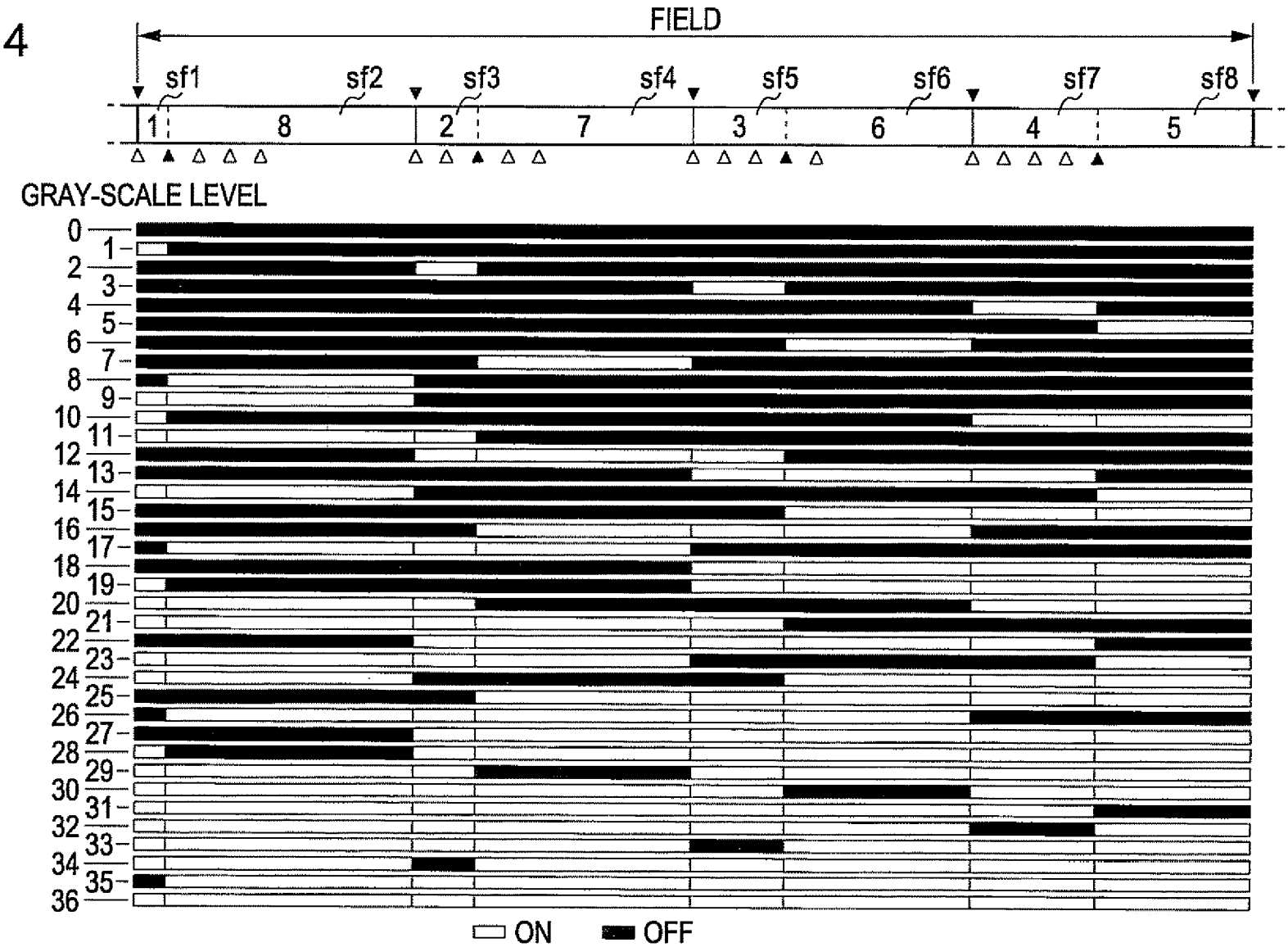
FIG. 4 is a view that shows patterns of grayshade performed by the electro-optical device.

Next, performing the grayshade in what manner to allocate an on state or an off state in the above sub-fields sf1 to sf9 that constitute a field as described above will be described. FIG. 4 is a view that shows the allocation of an on state or an off state to the sub-fields sf1 to sf8 for each of the gray-scale levels "0" to "36". In the drawing, the gray-scale level "0" corresponds to the lowest gray-scale black color. As the gray-scale level increases, the brightness gradually increases. The gray-scale level "36" specifies white color, which is the highest gray scale. The outline rectangular symbol or the solid rectangular symbol corresponding to each sub-field each has a length of a time period of a corresponding one of the sub-fields. The outline rectangular symbol indicates allocating an on state (white color) to the liquid crystal element 120, and the solid rectangular symbol indicates allocating an off state (black color) to the liquid crystal element 120. In the present embodiment, because each of the liquid crystal elements 120 is set to a normally black mode, in the case where the gray-scale level is the lowest "0", the liquid crystal element 120, when it is in an off state over the sub-fields sf1 to sf8, appears black color display, which is the lowest gray scale, when one field is regarded as unit time.

Next, when the gray-scale level is any one of "1" to "8", the liquid crystal element 120 is made into an on state only in the sub-field sf1, sf3, sf5, sf7, sf8, sf6, sf4 or sf2 in the stated order. In this manner, when the gray-scale level is any one of "1" to "8", where the time period of one field is set to "1", the percentage of a period during which the liquid crystal element 120 is in an on state is 1/36, 2/36, 3/36, 4/36, 5/36, 6/36, 7/36 or 8/36, respectively.

Here, when the gray-scale level is, for example, "13", it is only necessary that the percentage of a period during which the liquid crystal element 120 is in an on state is simply set to 13/36. Thus, for example, it is conceivable that the liquid crystal element 120 is made into an on state in each of the sub-field sf2 of which the length of the time period is 8/36, the sub-field sf3 of which the length of the time period is 2/36 and the sub-field sf5 of which the length of the time period is 3/36 and is made into an off state in the other sub-fields. However, in the above configuration, it is necessary to have a substantially ideal electro-optic response characteristic in which, at the time when an on voltage (or an off voltage) is applied to the pixel electrode 118 of the liquid crystal element 120, the liquid crystal element 120 immediately displays black color (or white color). The liquid crystal element 120 has a relatively low electro-optic response characteristic. Thus, even when an on voltage (or an off voltage) is applied to the pixel electrode 118, the liquid crystal element 120 has a characteristic that the reflectance ratio is not saturated immediately but it gradually approaches black color (or white color). Therefore, when the sub-fields, in which the liquid crystal element 120 enters an on state, are discontinuous, the liquid crystal element 120, before it reaches sufficient black color in a sub-field in which the liquid crystal element 120 is in an on state, enters a sub-field in which the liquid crystal element 120 is in an off state and appears white color and, after that, enters a sub-field in which the liquid crystal element 120 is in an on state again. Thus, there is a high possibility that, in each of the sub-fields, expected black color or white color display is not displayed and, as a result, appropriate grayshade cannot be achieved when viewed in one field. In particular, in the liquid crystal element 120, because the electro-optic response characteristic largely varies depending on an ambient temperature, it is assumed that an actual gray scale is likely to deviate from a desired gray scale as the temperature varies. Then, in the present embodiment, it is configured that, in each of the gray-scale levels, the sub-fields in which the liquid crystal element 120 is in an on state and the sub-fields in which the liquid crystal element 120 is in an off state are respectively made continuous.

In the present embodiment, the sum of the lengths of time periods of the sub-fields sf1 and sf2, the sum of the lengths of time periods of the sub-fields sf3 and sf4, the sum of the lengths of time periods of the sub-fields sf5 and sf6 and the sum of the lengths of time periods of the sub-fields sf7 and sf8, that is, the length of the time period of each group, each are set to 9/36 of the time period of one field. This means that, when focusing on a certain sub-field, a group, of which the sum of the lengths of time periods of the sub-fields is 9/36, is definitely present on any one of the preceding side or the following side in terms of time with respect to the focusing sub-field. Then, for the gray-scale levels "10" to "17", allocation is made in such a manner that the liquid crystal element is controlled to an on state over the certain sub-field and the group located on any one of the preceding side or the following side in terms of time with respect to the certain sub-field. Where the gray-scale level at this time is Q, because the length of the time period of the group is 9/36, the "certain sub-field" described herein means a sub-field of which the length of the time period is (Q−9)/36.

For example, for the gray-scale level "10", because the certain sub-field is the sub-field sf1 of which the ratio of the length of the time period is 1/36, the liquid crystal element 120 is made into an on state over the sub-field sf1 and the group located on the preceding side in terms of time with respect to the sub-field sf1 (the group consisting of the sub-fields sf7 and sf8 in the preceding field). In this manner, the sub-fields, in which the liquid crystal element 120 is in an on state, within one field are sf1, sf7 and sf8 and the sum of the lengths of time periods of these sub-fields is 10/36. Moreover, the sub-fields sf1, sf7 and sf8 are continuous when viewed among the adjacent sub-fields and, in addition, in regard to the sub-fields in which the liquid crystal element 120 is in an off state, the sub-fields are continuous from sf2 to sf6 within one field.

Similarly, for the gray-scale level "11 (12, 13)", the liquid crystal element 120 is made into an on state over the sub-field sf3 (sf5, sf7) of which the length of the time period is 2/36 (3/36, 4/36) and a group consisting of the sub-fields sf1 and sf2 (sf3 and sf4, sf5 and sf6) located on the preceding side in terms of time with respect to the sub-field sf3 (sf5, sf7). Next, for the gray-scale level "14", the liquid crystal element 120 is made into an on state over the sub-field sf8 of which the length of the time period is 5/36 and a group consisting of the sub-fields sf1 and sf2 located on the following side in terms of time with respect to the sub-field sf8. Similarly, for the gray-scale level "15 (16, 17)", the liquid crystal element 120 is made into an on state over the sub-field sf6 (sf4, sf2) of which the length of the time period is 6/36 (7/36, 8/36) and a group consisting of the sub-fields sf7 and sf8 (sf5 and sf6, sf3 and sf4) located on the following side in terms of time with respect to the sub-field sf6 (sf4, sf2).

Next, for the gray-scale levels "19" to "26", allocation is made in such a manner that the liquid crystal element is controlled to an on state over the certain sub-field and the two groups located on any one of the preceding side or the following side in terms of time with respect to the certain sub-field. Where the gray-scale level at this time is R, because the sum of the lengths of the time periods of the two groups is 18/36, the "certain sub-field" described herein means a sub-field of which the length of the time period is (R−18)/36. For example, for the gray-scale level "19", because the certain sub-field is the sub-field sf1 of which the ratio of the length of the time period is 1/36, the liquid crystal element 120 is made into an on state over the sub-field sf1 and the groups located on the preceding side in terms of time with respect to the sub-field sf1 (the group consisting of the sub-fields sf5 and sf6 and the group consisting of the sub-fields sf7 and sf8 in the preceding field). In this manner, the sub-fields, in which the liquid crystal element 120 is in an on state, within one field are sf1, sf5, sf6, sf7 and sf8 and the sum of the lengths of time periods of these sub-fields is 19/36. Moreover, the sub-fields sf1, sf5, sf6, sf7 and sf8 are continuous when viewed among the adjacent sub-fields and, in addition, in regard to the sub-fields in which the liquid crystal element 120 is in an off state, the sub-fields are continuous from sf2 to sf4 within one field.

Similarly, for the gray-scale level "20 (21, 22)", the liquid crystal element 120 is made into an on state over the sub-field sf3 (sf5, sf7) of which the length of the time period is 2/36 (3/36, 4/36) and two groups, consisting of the group of the sub-fields sf7 and sf8 and the group of the sub-fields sf1 and sf2 (two groups consisting of the group of the sub-fields sf1 and sf2 and the group of the sub-fields sf3 and sf4, two groups consisting of the group of the sub-fields sf3 and sf4 and the group of the sub-fields sf5 and sf6), located on the preceding side in terms of time with respect to the sub-field sf3 (sf5, sf7). Next, for the gray-scale level "23", the liquid crystal element 120 is made into an on state over the sub-field sf8 of which the length of the time period is 5/36 and two groups, consisting of the group of the sub-fields sf1 and sf2 and the group of the sub-fields sf3 and sf4, located on the following side in terms of time with respect to the sub-field sf8. Similarly, for the gray-scale level "24 (25, 26)", the liquid crystal element 120 is made into an on state over the sub-field sf6 (sf4, sf2) of which the length of the time period is 6/36 (7/36, 8/36) and two groups, consisting of the group of the sub-fields sf7 and sf8 and the group of the sub-fields sf1 and sf2 (two groups consisting of the group of the sub-fields sf5 and sf6 and the group of the sub-fields sf7 and sf8, two groups consisting of the group of the sub-fields sf3 and sf4 and the group of the sub-fields sf5 and sf6), located on the following side in terms of time with respect to the sub-field sf6 (sf4, sf2).

Note that, when the gray-scale level is any one of "28" to "35", the liquid crystal element 120 is made into an off state only in the sub-field sf2, sf4, sf6, sf8, sf7, sf5, sf3 or sf1 in the stated order. Then, when the gray-scale level is the highest "36", the liquid crystal element 120 is made into an on state over the sub-fields sf1 to sf8. In addition, when the gray-scale level is "9", it is only necessary that the liquid crystal element 120 is made into an on state in two sub-fields that belong to any one of the groups; however, in the present embodiment, in terms of suppressing the displacement to a lesser degree from the barycenter of the sub-fields in which the liquid crystal element 120 is in an on state when the gray-scale level is the adjacent "8" or "10", the liquid crystal element 120 is made into an on state over the group of the sub-fields sf1 and sf2. Similarly, when the gray-scale level is "18 (27)", it is only necessary that the liquid crystal element 120 is made into an on state in the sub-fields of the continuous two groups (three groups). Here, the liquid crystal element 120 is made into an on state over the two groups consisting of the group of the sub-fields sf5 and sf6 and the group of the sub-fields sf7 and sf8 (three groups consisting of the group of the sub-fields sf3 and sf4, the group of the sub-fields sf5 and sf6 and the group of the sub-fields sf7 and sf8).

In the present embodiment as described above, the gray-scale display of 37 levels in total is possible in steps of one level from the gray-scale level "0" to the gray-scale level "36". Then, in any one of 19 steps from the gray-scale levels "9" to "27", both the sub-fields in which the liquid crystal element 120 is in an on state and the sub-fields in which the liquid crystal element 120 is in an off state are respectively continuous when viewed within one field or adjacent fields. Note that, in regard to the gray-scale levels "0" to "8" and the gray-scale levels "28" to "36" other than the above, because the number of sub-fields in which the liquid crystal element 120 enters any one of an on state or an off state is "0" or "1", only the sub-fields in which the liquid crystal element 120 enters the other one of an on state or an off state are continuous.

In general, it has been known that, as the displacement of the barycenter in the period of sub-fields in which the liquid crystal element is in an on state between the adjacent gray-scale levels is reduced, the gray scale display is more appropriately performed (which is described in JP-A-2004-325996). In the present embodiment, as shown in FIG. 4, when an on state or an off state of the liquid crystal element 120 is allocated to the sub-fields sf1 to sf8, the displacement of the barycenter in the period of the sub-fields in which the liquid crystal element 120 is in an on state is small between the adjacent gray-scale levels. In the present embodiment, one field is divided into eight sub-fields; however, by dividing the one field into further more number of sub-fields, the displacement of the barycenter between the adjacent gray scales becomes small. In addition, in the present embodiment, because the lengths of time periods of the sub-fields sf1 to sf8 are differentiated from one another, the sub-fields in which the liquid crystal element is in an on state are made continuous and then sub-fields in which the liquid crystal element is made into an on state or an off state are specified in the above described manner, there is no difficulty in combination of sub-fields in which the liquid crystal element is made into an on state or an off state.

Conversion Using Conversion Table

Next, the conversion using the conversion table 30 for actually performing the above described grayshade will be described with reference to FIG. 5. As shown in the drawing, in the conversion table 30, a gray-scale level that is specified by the display data Da read out from the memory 20 is converted into data Db that specify an on state or an off state of the liquid crystal element 120 for each of the sub-fields sf1 to sf8. Note that, in the drawing, "1" means to specify an on state of the liquid crystal element 120 and "0" means to specify an off state of the liquid crystal element 120. For example, when the gray-scale level is "13", it is specified to make the liquid crystal element 120 enter an on state in the sub-fields sf5 to sf7 and make the liquid crystal element 120 enter an off state in the other sub-fields. By controlling the liquid crystal element to an on state or an off state in accordance with the data Db that are converted using the conversion table, it is possible to achieve the grayshade as shown in FIG. 4. Note that, in FIG. 5, "1" with hatching in the gray-scale levels "10" to "17" and "19" to "26" indicates that it is the above described "certain one sub-field".

Scanning Line Driving Circuit

In the case in which the liquid crystal element 120 is made to enter an on state or an off state in correspondence with each of the sub-fields sf1 to sf9 as in the case of the present embodiment, when the scanning lines are simply selected in the order of the first, second, third, fourth, . . . , 1079th and 1080th lines, it is necessary to complete selection of all the scanning lines within the time period of the shortest sub-field sf1. In other words, when the scanning lines are selected in the order of the first, second, third, fourth, . . . , 1079th and 1080th lines, it is necessary to set the length of the time period of the shortest sub-field sf1 equal to or longer than time required to select all the scanning lines. Then, in the present embodiment, using a technology described in JP-A-2004-177930, the scanning lines are selected not in the order of the first, second, third, fourth, . . . , but in the order of skipping n lines, such as in the order of the first, (n+1)th, second, (n+2)th, third, (n+3)th, fourth, (n+4)th, . . . . However, in the present embodiment, it is necessary to consider the relationship that the start timing of each of the even-numbered sub-fields is sequentially delayed from the start timing of the odd-numbered sub-field that forms a group together.

Figure 6:
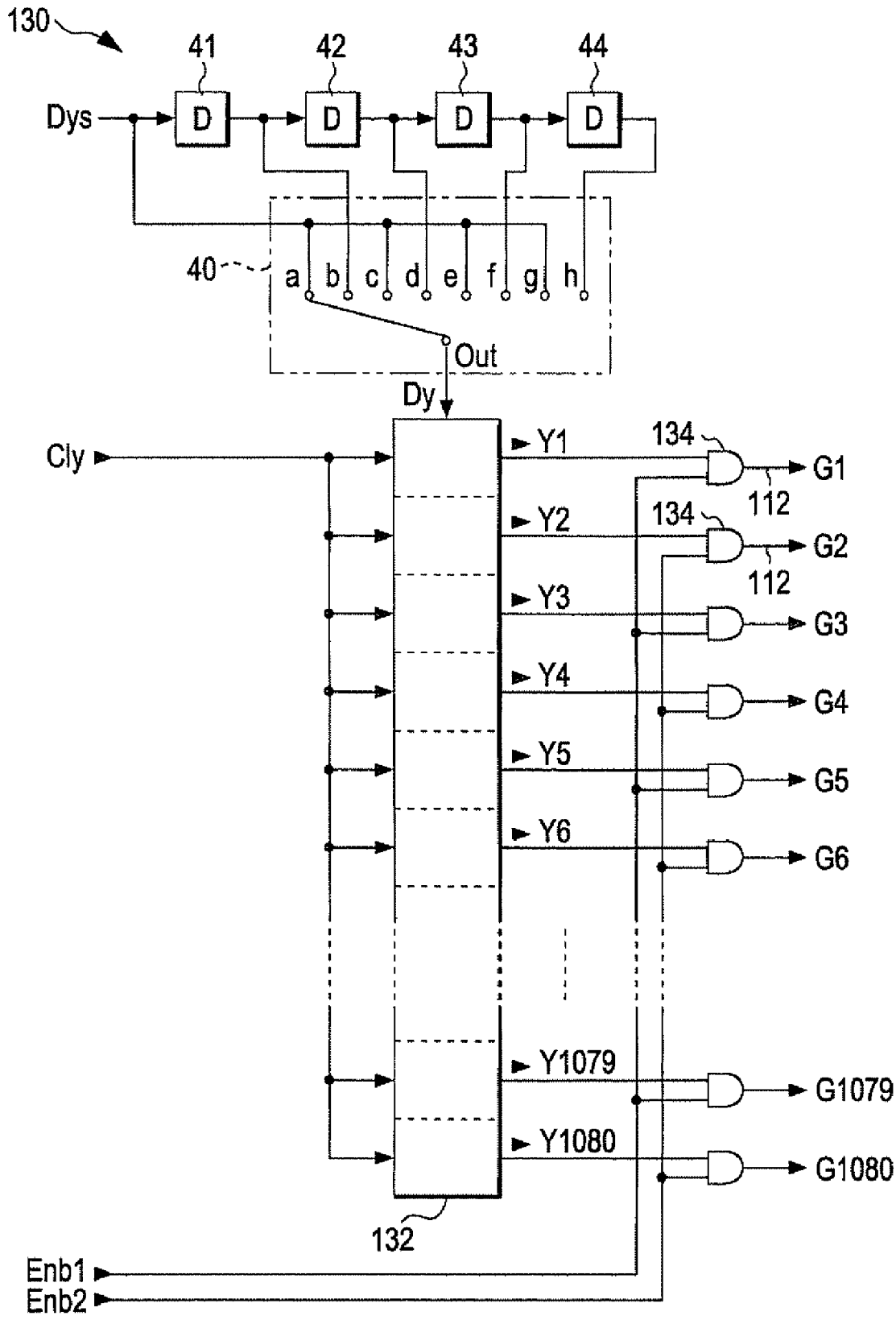
FIG. 6 is a view that shows the configuration of a scanning line driving circuit in the electro-optical device.
Figure 7:
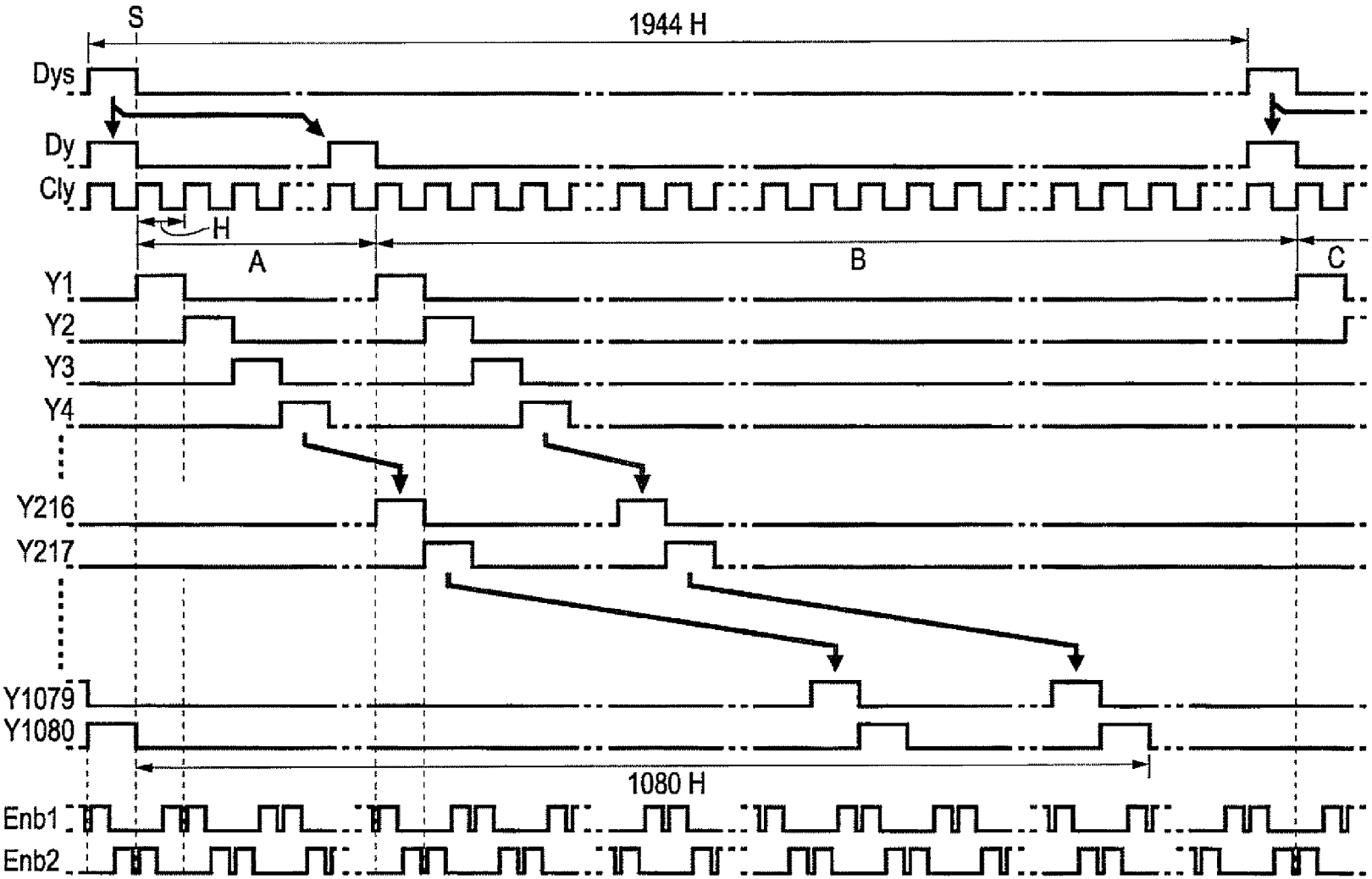
FIG. 7 is a timing chart that shows the operation of the scanning line driving circuit.

FIG. 6 is a block diagram that shows the configuration of the scanning line driving circuit 130 in the present embodiment. In the drawing, a clock signal Cly, a start pulse Dy, and enable signals Enb1 and Enb2 each are supplied from the control circuit 10. The clock signal Cly has a duty ratio of 50%, the start pulse Dys is supplied at intervals of 1944 cycles of the clock signal Cly. Specifically, the start pulse Dys has a pulse width (H level) of one cycle of the clock signal Cly as shown in FIG. 7 and is supplied so as to attain an H level in synchronization with the rising timing of the clock signal Cly at time intervals of 1944 cycles of the clock signal Cly.

A delay circuit 41 delays and outputs the start pulse Dys by the 215 cycles of the clock signal Cly. In addition, delay circuits 42, 43 and 44 each delay and output an input signal by the 216 cycles of the clock signal Cly. A switch 40 selects any one of input ends a to h in accordance with an instruction of the control circuit 10 in the stated order and outputs the start pulse Dy from an output end Out. Here, the input ends a, c, e and g of the switch 40 are supplied with the start pulse Dys, and the input ends b, d, f and h of the switch 40 are supplied with a delay signal generated by the delay circuit 41, 42, 43 or 44.

The control circuit 10 outputs the start pulse Dys at time intervals of 1944 cycles of the clock signal Cly. Then, when one start pulse Dys is output and the switch 40 is controlled to select the input end a, the timing at which the output of this start pulse Dys has been completed (the timing at which a shift signal Y1, which will be described later, attains an H level) is set to the start timing S of a field (see FIG. 7). As described above, in the present embodiment, because the scanning line driving circuit 130 performs interlaced scanning, when it is observed from the start of one field, there is a possibility that it is difficult to intuitively understand scanning (selection) of scanning lines by the scanning line driving circuit 130 and writing of a voltage in each sub-field. Then, in order to describe the operation of the scanning line driving circuit 130, periods from the above start timing S of the field by the cycles of 215, 1729, 431, 1513, 647, 1297, 863 and 1081 of the clock signal Cly are respectively denoted as A, B, C, X, E, F, G and H. Here, the sum of the lengths of the periods A and B equals to 1944 cycles of the clock signal Cly. Similarly, the sum of the lengths of the periods C and D, the sum of the lengths of the periods E and F and the sum of the lengths of the periods G and H each equal to 1944 cycles of the clock signal Cly. Thus, the timing of the boundary between the periods A and B is shifted toward the preceding side along the time axis by one cycle of the clock signal Cly from the timing of the boundary between the sub-fields sf1 and sf2 shown in FIG. 3. For the timings of the boundaries between the periods C and D, the periods E and F and the periods G and H as well, they are shifted toward the preceding side along the time axis by one cycle of the clock signal Cly from the timings of the boundaries between the sub-fields sf3 and sf4, the sub-fields sf5 and sf6 and the sub-fields sf7 and sf8, respectively.

The control circuit 10 controls the switch 40 in such a manner that the input end a is selected at the timing that is one cycle of the clock signal Cly before the start timing of the period A and, thereafter, the input ends b to h are respectively selected at the timings that are one cycle of the clock signal Cly before the start timings of the periods B to H. The start pulse Dys that is supplied at the timing that is one cycle before the start timing of the period A (C, E, G) is output through the input end a (c, e, g) of the switch 40 as the start pulse Dy for the sub-field sf1 (sf3, sf5 sf7), respectively. On the other hand, the start pulse Dys supplied at the timing that is one cycle before the start timing of the period A is delayed by the 215 cycles of the clock signal Cly by the delay circuit 41, that is, at the timing that is one cycle before the start timing of the period B, and is output as the start pulse Dy for the sub-field sf2. Similarly, the start pulse Dys supplied at the timing that is one cycle before the start timing of the period C (E, G) is delayed by the 431 (647, 863) cycles of the clock signal Cly by the delay circuits 41 and 42 (41 to 43, 41 to 44) and is output as the start pulse Dy for the sub-field sf4 (sf6, sf8) at the timing that is one cycle before the start timing of the period D (F, G).

A shift register 132 includes the first stage to the 1080th stage unit circuits. The unit circuit of each stage in the shift register 132 delays an input signal by one cycle of the clock signal Cly and outputs the signal as a shift signal, and then supplies the signal to the unit circuit of the next stage as an input signal. The input signal of the first stage unit circuit is the start pulse Dy output from the switch 40.

An AND circuit 134 is provided in correspondence with each stage (each line). The odd-numbered AND circuits 134 each output logical multiplication of a shift signal of the corresponding stage and the enable signal Enb1 to the scanning line 112 as a scanning signal of that line, and the even-numbered AND circuits 134 each output logical multiplication of a shift signal of the corresponding stage and the enable signal Enb2 to the scanning line 112 as a scanning signal of that line. Here, the scanning signals that are supplied to the first, second, third, fourth, . . . , 1079th and 1080th scanning lines 112 are respectively denoted as G1, G2, G3, G4, . . . , G1079 and G1080.

The enable signal Enb1, as shown in FIG. 7, has a cycle that is twice as long as that of the clock signal Cly, and a series of two pulses, each having a slightly narrower length than the length of the half cycle of the clock signal Cly, are output so as to place the timing, at which the clock signal Cly rises from an L level to an H level, in between. In addition, the enable signal Enb2, as shown in the same drawing, is obtained by shifting the phase of the enable signal Enb1 by 180 degrees. Here, in regard to the enable signals Enb1 and Enb2, in a period in which the start pulse Dy is output (attains an H level), they are output so that one pulse of the enable signal Enb1 and, after that, one pulse of the enable signal Enb2 are included.

As the control circuit 10 outputs the start pulse Dys that specifies the start of one field and controls the switch 40 to select the input end a, the start pulse Dys is input to the first stage unit circuit in the shift register 132 as the start pulse Dy for the subfield sf1. Thus, shift signals Y1, Y2, Y3, Y4, . . . , Y1079, and Y1080 are obtained by sequentially delaying the start pulse Dys (start pulse Dy) by one cycle of the clock signal Cly, as shown in FIG. 7.

Note that the time period from time at which the shift signal Y1 attains an H level to time at which the shift signal Y1080 attains an L level equals to 1080 cycles of the clock signal Cly. In the present embodiment, the reason why the length of the time period of one group is set for 1944 cycles of the clock signal Cly is as follows. That is, this is because the time period from time when the shift signal Y1 attains an H level by the transfer of a start pulse Dy to time when the shift signal Y1080 attains an L level is 1080 cycles of the clock signal Cly, and the time period of the 1080 cycles is made to correspond to a ratio "5" out of the ratio "36" of the length of the time period of one field. The length of the time period of one group having a ratio "9" is 1944 (=1080×9/5) cycles of the clock signal Cly.

On the other hand, the start pulse Dys is delayed by 215 cycles of the clock signal Cly by the delay circuit 41 and is input to the first stage unit circuit in the shift register 132 as the start pulse Dy for the sub-field sf2. Thus, the shift signals Y1, Y2, Y3, Y4, . . . , Y1079, and Y1080 are obtained by sequentially delaying, by one cycle of the clock signal Cly, the start pulse Dys, of which the timing has been delayed by 216 cycles of the clock signal Cly, as shown in the drawing.

At this time, the start pulse Dy of the preceding sub-field sf1 is being transferred by the unit circuits of the shift register 132. Specifically, in a period during which the shift signal Y216 is at an H level by the transfer of the start pulse Dy for the sub-field sf1, the shift signal Y1 attains an H level by the transfer of the start pulse Dy of the sub-field sf2. Thus, the shift signals Y216 to Y 1080 through the input end a of the switch 40 by the transfer of the start pulse Dy for the preceding sub-field sf1 and the shift signals Y1 to Y865 through the input end b of the switch 40 by the transfer of the start pulse Dy for the sub-field sf2 are output so as to overlap each other. At this time, the odd-numbered line shift signals and the even-numbered line shift signals overlappingly attain an H level. Thus, even when the pulses of the shift signals overlap each other, the odd-numbered shift signals are taken out by the enable signal Enb1 and the even-numbered shift signals are taken out by the enable signal Enb2 through the AND circuits 134 so as not to overlap each other. Thus, as shown in FIG. 8, when viewed as the scanning signals supplied to the scanning lines 112, H levels do not overlap each other.

Figure 8:
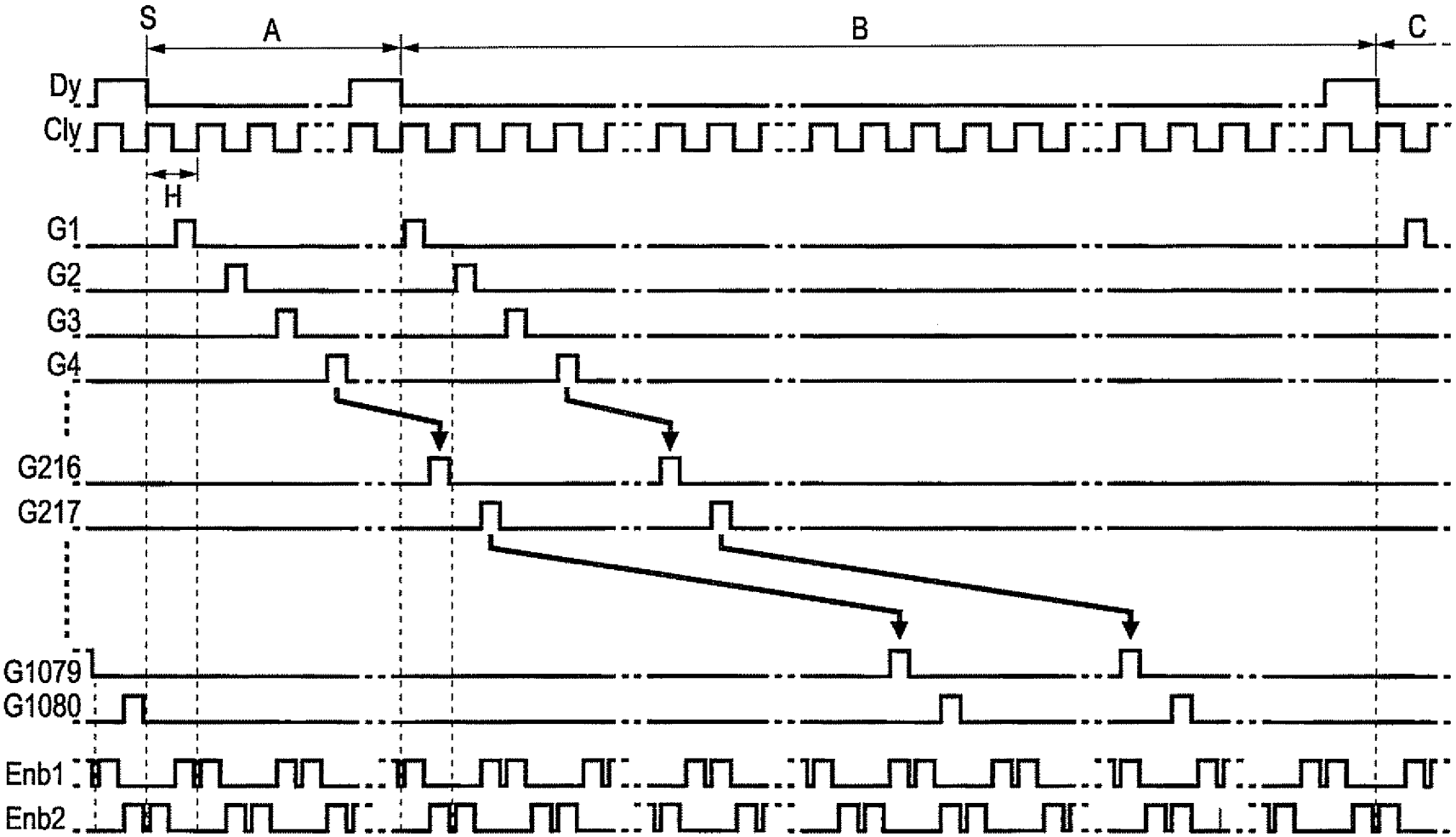
FIG. 8 is a view that shows scanning signals generated by the scanning line driving circuit.

Thus, as shown in FIG. 8, the scanning lines 112 are sequentially selected in the period A in a non-interlaced manner from the first to the 215th and then selected in the period B in an interlaced manner in the order of the first, 216th, second, 217th, third, 218th, . . . , 865th and 1080th (in the order with n being set to "215"), and, after that, are selected in a non-interlaced manner again from the 866th to the 1080th.

Figure 9:
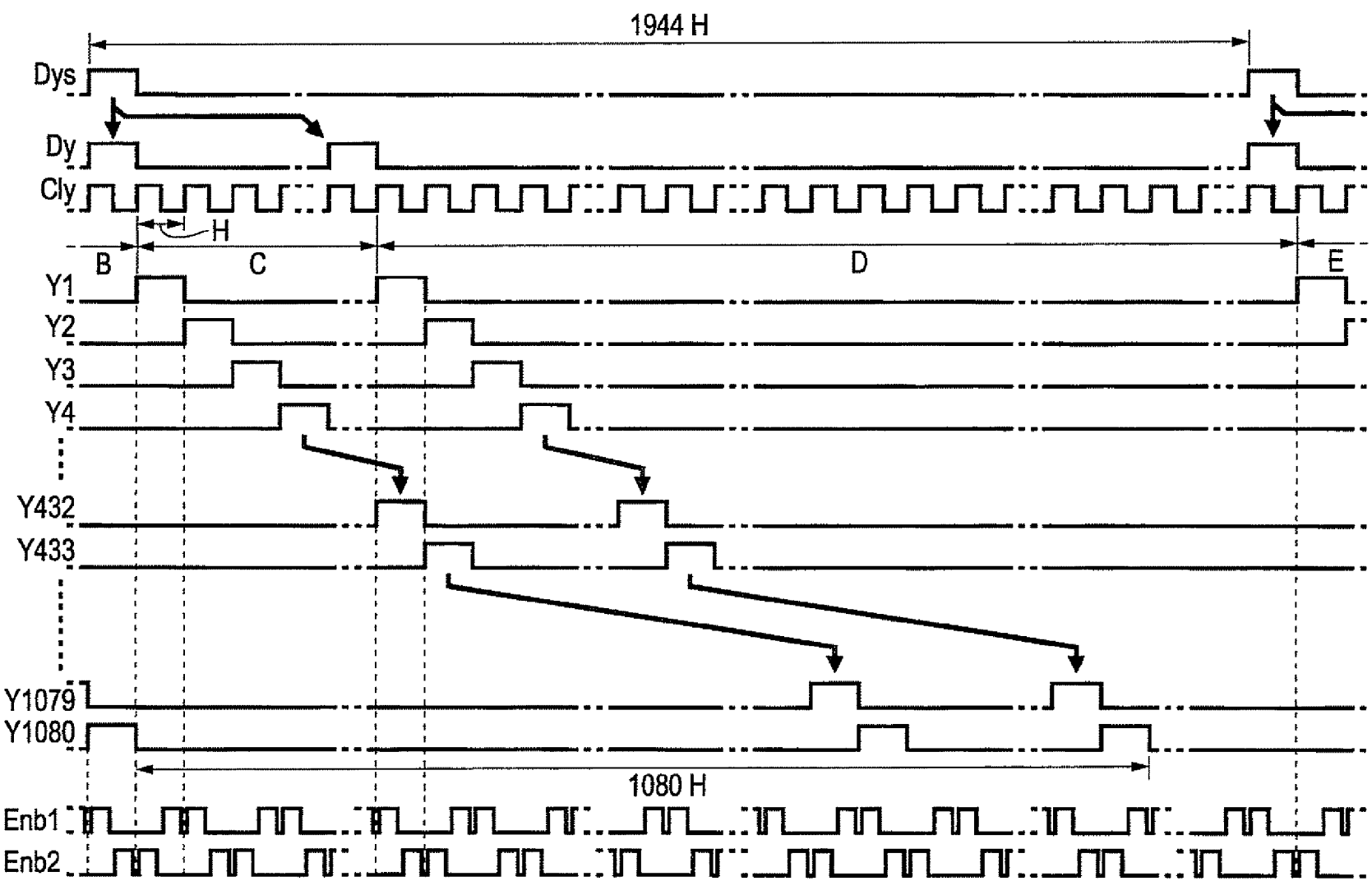
FIG. 9 is a timing chart that shows the operation of the scanning line driving circuit.
Figure 10:
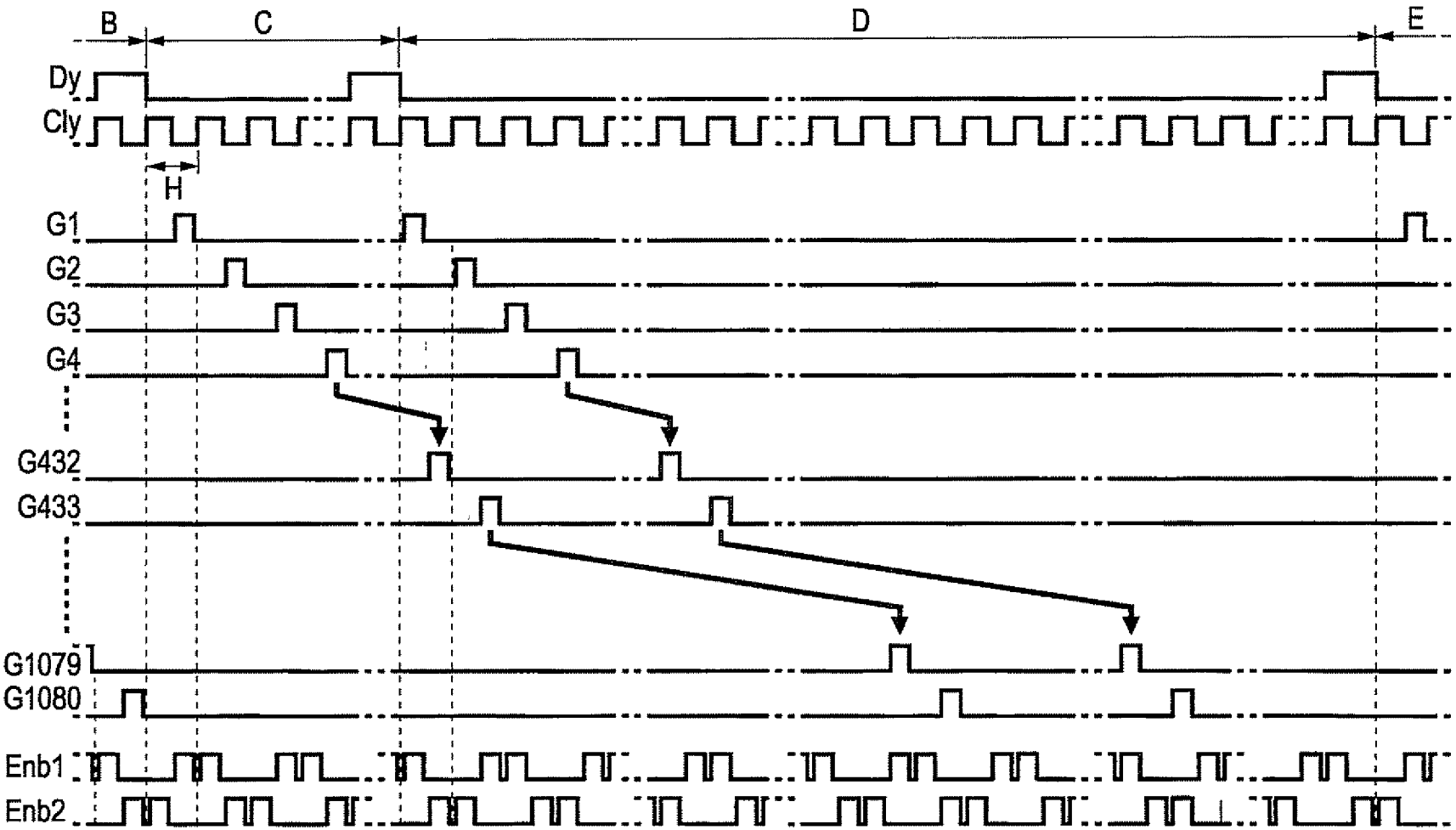
FIG. 10 is a view that shows scanning signals generated by the scanning line driving circuit.
Figure 11:
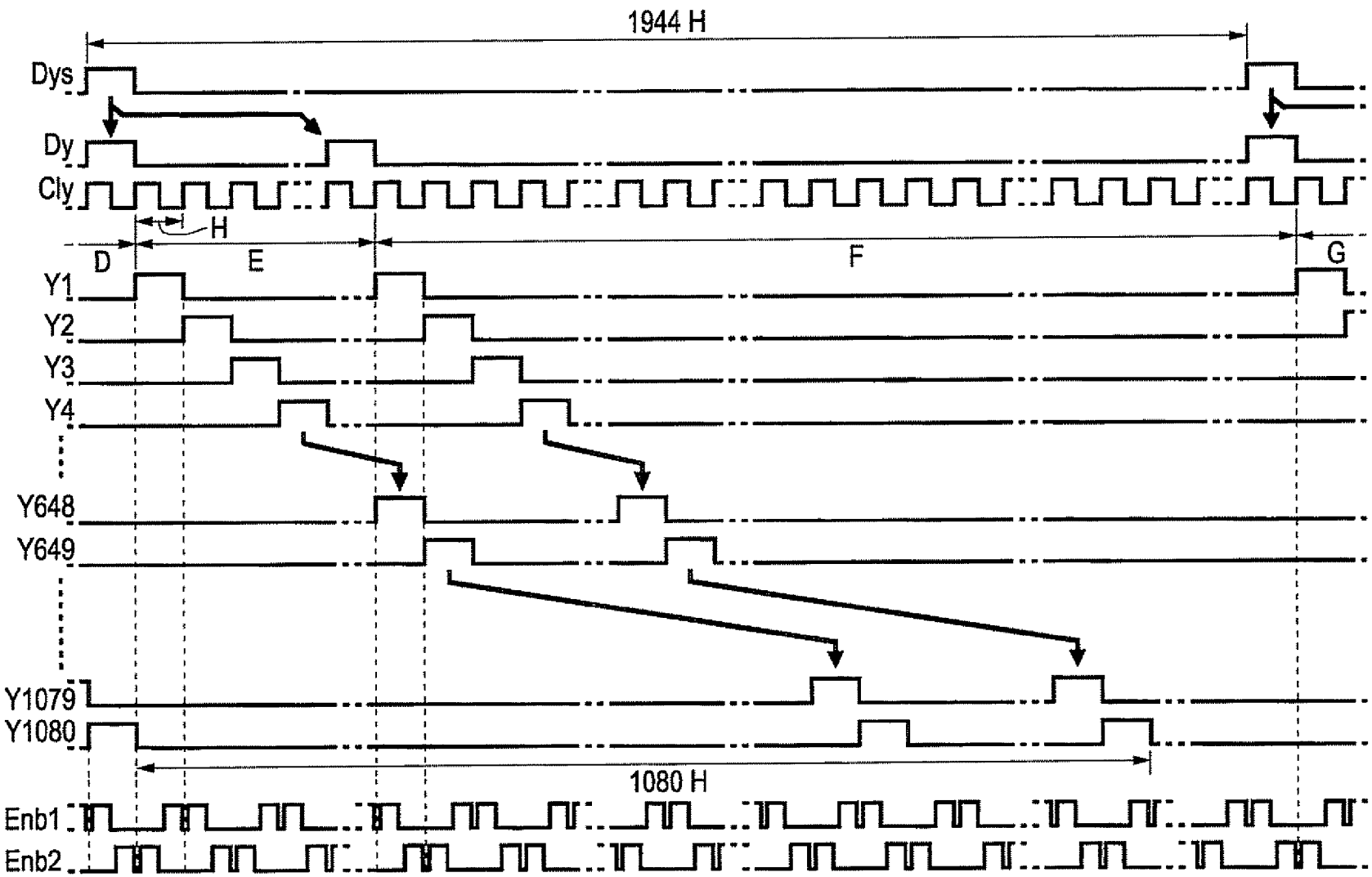
FIG. 11 is a timing chart that shows the operation of the scanning line driving circuit.
Figure 12:
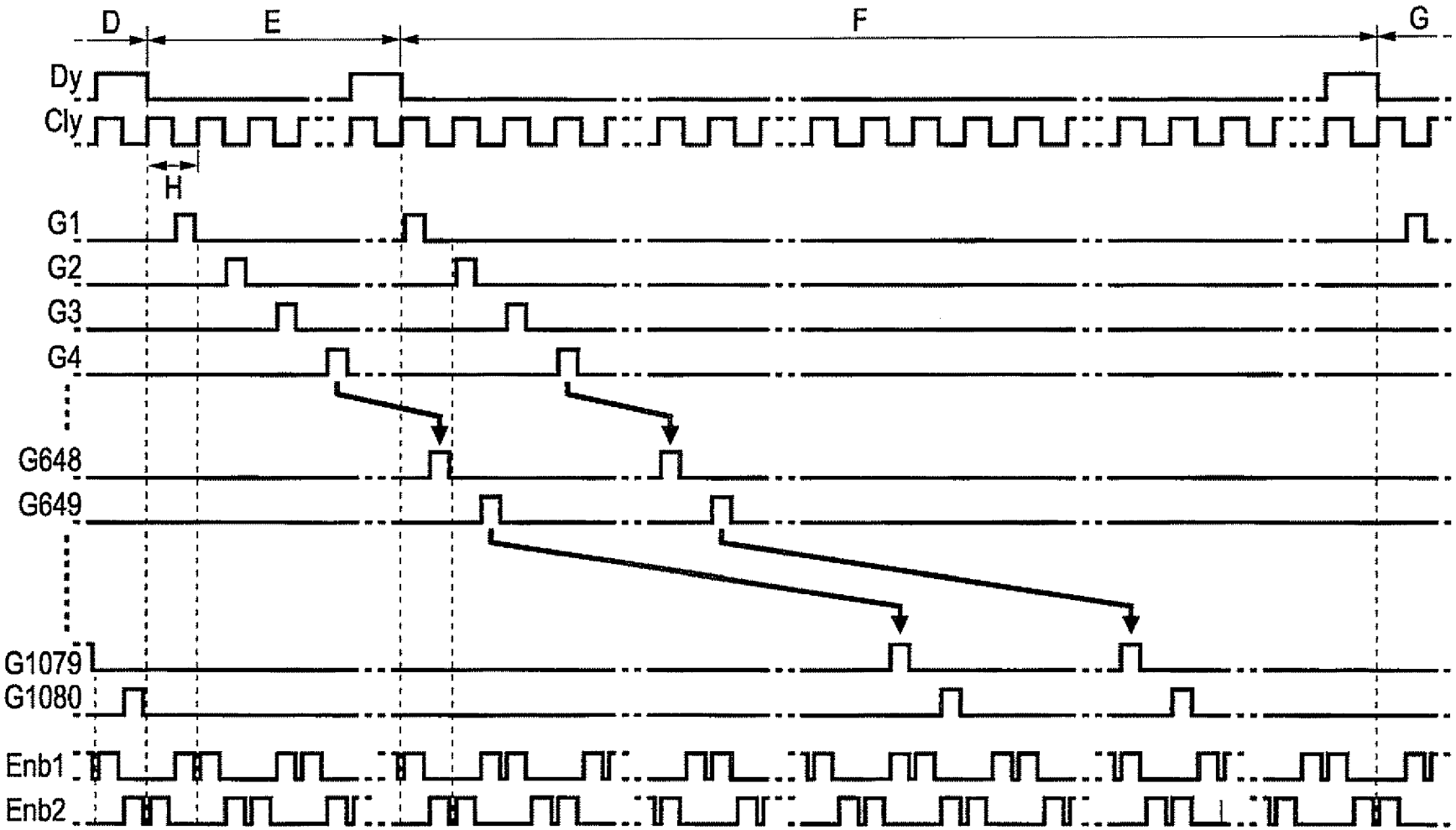
FIG. 12 is a view that shows scanning signals generated by the scanning line driving circuit.
Figure 13:
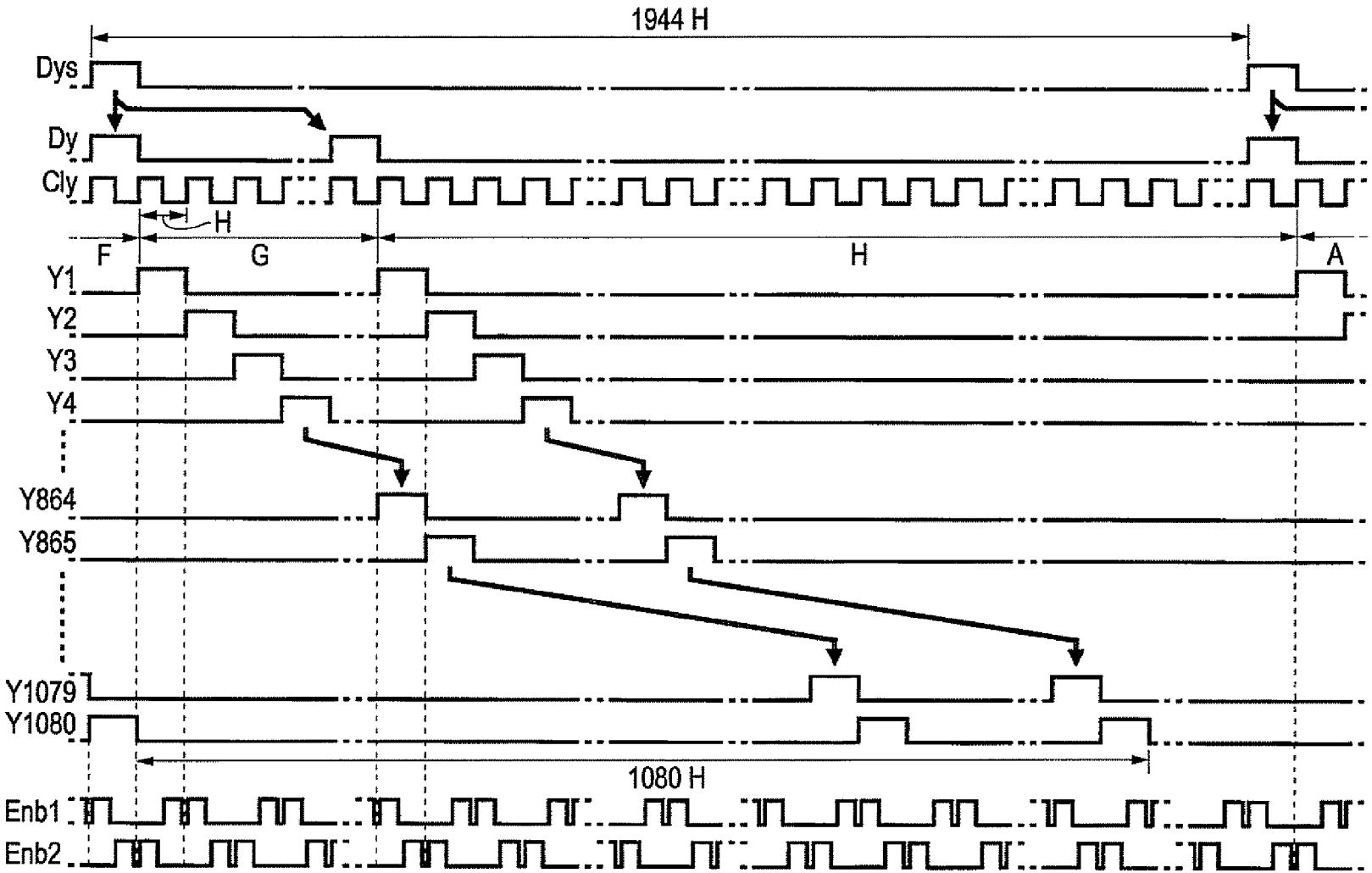
FIG. 13 is a timing chart that shows the operation of the scanning line driving circuit.
Figure 14:
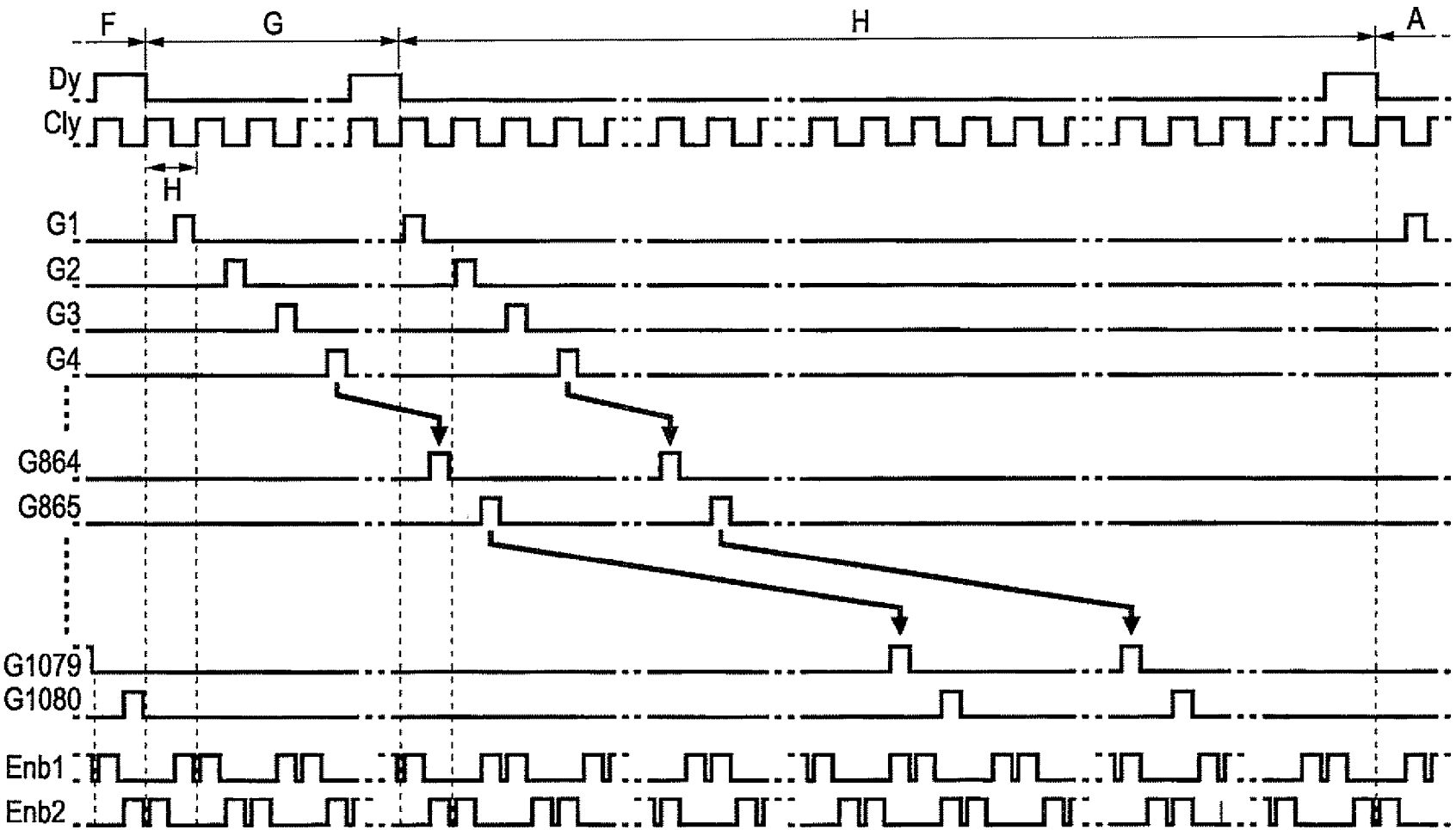
FIG. 14 is a view that shows scanning signals generated by the scanning line driving circuit.

Here, a set of the periods A and B is described; however, in another set of periods, only the amount of delay of the start pulse Dys is different and the similar operation is performed. That is, as shown in FIG. 10, the scanning lines 112 are sequentially selected in the period C in a non-interlaced manner from the first to the 431st and then selected in the period D in an interlaced manner in the order of the first, 432nd, second, 433rd, third, 434th, . . . , 649th and 1080th (in the order with n being set to "431"), and, after that, are selected in a non-interlaced manner again from the 650th to the 1080th. Note that the waveform of a shift signal that is the source of scanning signals in the period C and the period D is shown in FIG. 9. In addition, as shown in FIG. 12, the scanning lines 112 are sequentially selected in the period E in a non-interlaced manner from the first to the 647th and then selected in the period F in an interlaced manner in the order of the first, 648th, second, 649, third, 650th, . . . , 433rd and 1080th (in the order with n being set to "647"), and, after that, are selected in a non-interlaced manner again from the 434th to the 1080th. Note that the waveform of a shift signal that is the source of scanning signals in the period E and the period F is shown in FIG. 11. Then, as shown in FIG. 14, the scanning lines 112 are sequentially selected in the period G in a non-interlaced manner from the first to the 863rd and then selected in the period H in an interlaced manner in the order of the first, 864th, second, 865th, third, 866th, . . . , 217th and 1080th (in the order with n being set to "863"), and, after that, are selected in a non-interlaced manner again from the 218th to the 1080th. Note that the waveform of a shift signal that is the source of scanning signals in the period G and the period H is shown in FIG. 13.

In FIG. 8, the time period from time when the scanning signal of a scanning line attains an H level by the transfer of the start pulse Dy that is supplied immediately before the period A to time when the same scanning signal attains an H level again by the transfer of the start pulse Dy that is supplied immediately before the period B is the length of a time period corresponding to the sub-field sf1 of the pixels located in correspondence with the scanning line. In addition, the time period from time when the scanning signal of the scanning line attains an H level by the transfer of the start pulse Dy that is supplied immediately before the period B to time when the same scanning signal attains an H level again by the transfer of the start pulse Dy that is supplied immediately before the period C is the length of a time period corresponding to the sub-field sf2 of the pixels located in correspondence with the scanning line. Here, the timing at which the scanning signal attains an H level by the transfer of the start pulse Dy that is supplied immediately before the period A or C is shifted toward the following side in terms of time approximately by half the cycle of the clock signal Cly from the timing at which the scanning signal attains an H level by the transfer of the start pulse Dy that is supplied immediately before the period B. In addition, in the present embodiment, it is configured so that only two shift signals, that is, a shift signal in the odd-numbered line and a shift signal in the even-numbered line, attain an H level at the same time. For the above reasons, the length of a time period corresponding to the sub-field sf1 in each line is slightly shorter in comparison with the description of FIG. 3, and the length of a time period corresponding to the sub-field sf2 is slightly longer; however, there is almost no actual influence. In regard to the other odd-numbered sub-fields sf3, sf5 and sf7 as well, the length of a time period thereof is slightly shorter in comparison with the description of FIG. 3 as in the case of the sub-field sf1, and, in regard to the other even-numbered sub-fields sf4, sf6 and sf8 as well, the length of a time period thereof is slightly longer as in the case of the sub-field sf2; however, there is almost no actual influence (see FIG. 10, FIG. 12 and FIG. 14).

Data Line Driving Circuit

Next, the data line driving circuit 140 shown in FIG. 1 will be described. The data line driving circuit 140 converts the data Db, which are converted using the conversion table 30, into a voltage of which polarity is specified by the control circuit 10 and then supplies the data line 114 of a column corresponding to the data Db with the voltage as a data signal. Specifically, the data line driving circuit 140, when the data Db converted using the conversion table 30 is "1" that indicates an on state of the liquid crystal element 120, converts the data Db into a voltage Vw(+) when the control circuit 10 specifies positive polarity writing, or converts the data Db into a voltage Vw(−) when the control circuit 10 specifies negative polarity writing. On the other hand, the data line driving circuit 140, when the data Db is "0" that indicates an off state of the liquid crystal element 120, converts the data Db into a voltage Vb(+) when the control circuit 10 specifies positive polarity writing, or converts the data Db into a voltage Vb(−) when the control circuit specifies negative polarity writing. Note that data signals that are supplied to the first, second, third, . . . , 1920th data lines 114 are denoted as data signals d1, d2, d3, . . . , d1920, and the j-th data signal, when the column is not specified, is denoted as dj.

Figure 15:
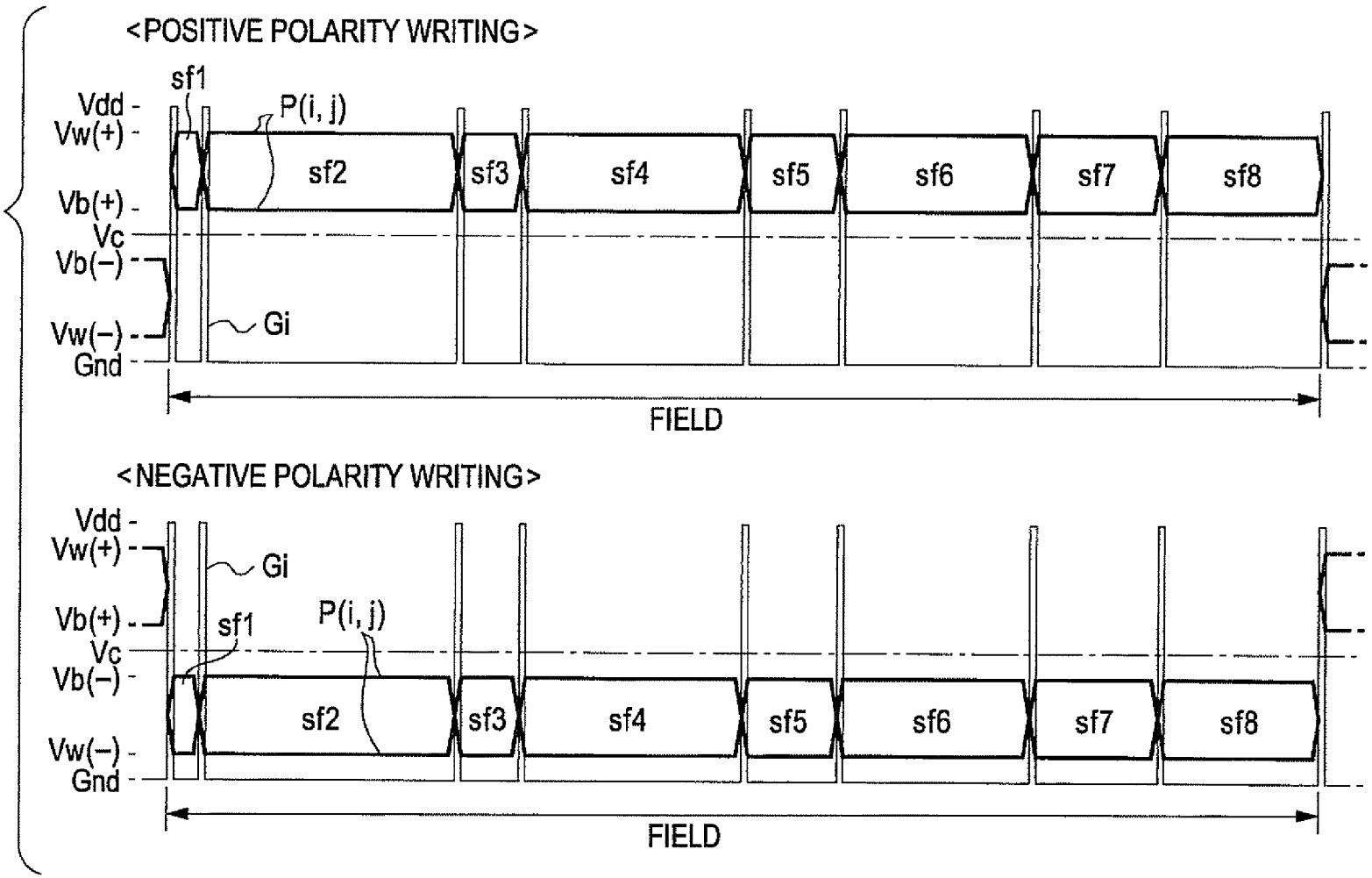
FIG. 15 is a view that shows writing of on or off in each sub-field in the electro-optical device.

The voltages Vw(+) and Vw(−) are used as an on voltage for the liquid crystal element 120 and, as shown in FIG. 15, are symmetrical with respect to the voltage Vc. As described above, in the present embodiment, because the voltage LCcom is applied to the opposite electrode 108, as the voltage Vw(+) is applied to the pixel electrode 118, a voltage difference between the voltage Vw(+) and the voltage LCcom is written to the liquid crystal element 120 to thereby make the liquid crystal element 120 enter an on state, and, as the voltage Vw(−) is applied to the pixel electrode 118, a voltage difference between the voltage Vw(−) and the voltage LCcom is written to the liquid crystal element 120 to thereby make the liquid crystal element 120 enter an on state. Note that the on voltage employs a voltage that sets a voltage difference to about 1 to 1.5 times as high as the saturation voltage as described above; however, when the pixel electrode 118 is applied with the voltage Vw(+) or Vw(−), saturation response time, for which the reflectance ratio of the liquid crystal element 120 is saturated to appear white color, is longer than the length of a time period of the shortest sub-field sf1. That is, the length of a time period of the sub-field sf1 is set shorter than the saturation response time of the liquid crystal element 120. On the other hand, the voltages Vb(+) and Vb(−) are used as an off voltage for the liquid crystal element 120 and, as shown in FIG. 15, are symmetrical with respect to the voltage Vc. As the voltage Vb(+) is applied to the pixel electrode 118, a voltage difference between the voltage Vb(+) and the voltage LCcom is written to the liquid crystal element 120 to thereby make the liquid crystal element 120 enter an off state, and, as the voltage Vb(−) is applied to the pixel electrode 118, a voltage difference between the voltage Vb(−) and the voltage LCcom is written to the liquid crystal element 120 to thereby make the liquid crystal element 120 enter an off state. Here, as a direct-current component is applied to the liquid crystal element 120, the liquid crystal 105 degrades. Thus, the pixel electrode 118 is alternately applied with a high level side voltage or a low level side voltage with respect to the reference voltage Vc (alternating current driving). In this alternating current driving, writing polarity refers to setting a voltage applied to the pixel electrode 118, that is, setting the voltage of a data signal to a high level side or a low level side with respect to the reference voltage Vc. When the voltage is set to the high level side, it means that the writing polarity is positive polarity. When the voltage is set to the low level side, it means that the writing polarity is negative polarity. Thus, the voltages Vw(+) and Vb(+) are positive polarity voltages, and the voltages Vw(−) and Vb(−) are negative polarity voltages. Note that, in the present embodiment, the written polarity uses the voltage Vc as a reference; however, the voltage uses a ground electric potential Gnd corresponding to the L level of a logic level as a reference of voltage zero, unless otherwise specified.

Incidentally, the voltage LCcom applied to the opposite electrode 108 is set to a lower side than the reference voltage Vc. This is because there occurs a push down in which the electric potential of the drain (pixel electrode 118) decreases when the n-channel transistor 116 switches from an on state to an off state because of a parasitic capacitance between the gate and drain electrodes. If the voltage LCcom is made to coincide with the reference voltage Vc, the effective voltage value of the liquid crystal element 120 through negative polarity writing is slightly higher than the effective voltage value through positive polarity writing because of push down (when the transistor 116 is of an n-channel type). For this reason, the voltage LCcom is set to an appropriate value that cancels the influence of push down in such a manner that the voltage LCcom is offset to the low level side with respect to the reference voltage Vc. However, when the influence of push down may be ignored, the voltage LCcom and the reference voltage Vc are set to coincide with each other. In addition, because the liquid crystal elements 120 are driven with alternating current as described above, in the present embodiment, the control circuit 10 is configured to alternately switch writing polarity to the data line driving circuit 140 between positive polarity and negative polarity once each period of one field.

Writing Operation

Next, the display operation of the electro-optical device 1 will be described. The control circuit 10 supplies the start pulse Dys, the clock signal Cly, the enable signals Enb1 and Enb2 to the scanning line driving circuit 130, as described above, and the scanning line driving circuit 130 supplies scanning signals to the scanning lines 112 in accordance with these signals. Thus, the control circuit 10 indirectly controls selection of the scanning line.

As described above, in the period A, the scanning lines 112 are sequentially selected in a non-interlaced manner from the first to the 215th. The control circuit 10, before selecting the first scanning line 112 in the period A, reads out the display data Da of the first row pixels in the first to 1920th columns from the memory 20 and supplies the display data Da to the conversion table 30. In this manner, the conversion table 30 sequentially converts the read display data Da into a gray-scale level, which is specified by the display data Da, and the data Db that make the liquid crystal element 120 enter an on state or an off state in correspondence with the sub-field sf1. For example, when the read display data Da are data to which the gray-scale level "10" is to be specified, in correspondence with the sub-field sf1, the display data Da are converted into "1" that makes the liquid crystal element 120 enter an on state (see FIG. 5). Note that, in the present embodiment as described above, writing polarity is alternately switched between positive polarity and negative polarity once each period of one field. Here, in this one field, it is assumed that positive polarity writing is specified.

The data line driving circuit 140 stores one line data Db corresponding to the converted first row and first column to the first row and 1920th column. After that, when the first scanning signal Y1 attains an H level, the data line driving circuit 140 converts the data Db to the voltage Vw(+) when the data Db is "1" or converts the data Db to the voltage Vb(+) when the data Db is "0". Thereafter, the data line driving circuit 140 supplies the voltages to the first to 1920th data lines 114 as data signals d1 to d1920. For example, when the first row and j-th column data Db is "0", the data signal dj is converted into the voltage Vb(+) when the scanning signal Y1 attains an H level.

Subsequently, as the first scanning signal Y1 attains an H level by the selection of the first scanning line 112, the transistors 116 of the pixels 110 located in the first row all enter an on state. Thus, the voltage of the data signal supplied to each of the data lines 114 is applied to the corresponding pixel electrode 118. Therefore, for the liquid crystal elements 120 of the first row pixels in the first, second, third, fourth, . . . , 1920th columns, the positive polarity voltage Vw(+) corresponding to an on state or the positive polarity voltage Vb(+) corresponding to an off state, specified by the data Db, is applied to each of the pixel electrodes and, then, a voltage difference with respect to the voltage LCcom applied to the opposite electrode 108 is held. Even when the transistor enters an off state, the voltage difference is held owing to its capacitive property.

Next, in the period A, the second scanning line 112 is selected, and the similar operation is executed at this time as well. That is, before the second scanning line 112 is selected, the display data Da of the second row pixels in the first to 1920th columns are read out from the memory 20 and are sequentially converted into the data Db in correspondence with the gray-scale levels and the sub-field sf1 by the conversion table 30. The data Db corresponding to the converted second row and first column to the second row and 1920th column are stored in the data line driving circuit 140. After that, when the second scanning signal Y2 attains an H level, that data Db are converted into the positive polarity voltage Vw(+) or Vb(+) and are respectively supplied to the first to 1920th data lines 114 as the data signals d1 to d1920. Then, as the scanning signal Y2 attains an H level, the transistors 116 located in the second line all enter an on state. Thus, for the liquid crystal elements 120 of the second row pixels in the first, second, third, fourth, . . . , 1920th columns, the voltage Vw(+) or the voltage Vb(+) that is specified by the data Db is applied to each of the pixel electrodes and, therefore, a voltage difference with the voltage LCcom is held in each of the above liquid crystal elements 120. In this manner, thereafter, in the period A, the similar operation is repeated to the 215th line the voltage Vb(+) or the voltage Vw(+) that is specified by the data Db is applied to each of the pixel electrodes and a voltage difference with the voltage LCcom is held in each of the liquid crystal elements 120.

Next, as it enters the period B, as described above, after the scanning lines 112 are selected in an interlaced manner in the order of the first, 216th, second, 217th, third, 218th, . . . , 865th and 1080th, the scanning lines 112 are selected in a non-interlaced manner again from the 866th to 1080th. In the above described scanning in the period B, the first to 215th scanning lines 112 are selected for writing in the sub-field sf2 and each are selected once in the period B. However, the 216th to 1080th scanning lines 112 each are selected twice in the period B. The first time is the writing for the sub-field sf1 and the second time is the writing for the sub-field sf2.

In the period C, the scanning lines 112 are selected for the sub-field sf3 in a non-interlaced manner in the order from the first to 431st lines. In addition, in the period D, the scanning lines 112 are selected in an interlaced manner in the order of the first, 432nd, second, 433rd, third, 434th, . . . , 649th and 1080th lines and, after that, selected in a non-interlaced manner again in the order from the 650th to 1080th lines. In the above described scanning in the period D, the first to 431st scanning lines 112 are selected for writing in the sub-field sf4. However, the 432nd to 1080th scanning lines 112 each are selected twice in the period D. The first time is the writing for the sub-field sf3 and the second time is the writing for the sub-field sf4. In the period E, the scanning lines 112 are selected for the sub-field sf5 in a non-interlaced manner in the order from the first to 647th lines. In addition, in the period I, the scanning lines 112 are selected in an interlaced manner in the order of the first, 648th, second, 649th, third, 650th, . . . , 433rd and 1080th lines and, after that, selected in a non-interlaced manner again in the order from the 434th to 1080th lines. In the above described scanning in the period F, the first to 647th scanning lines 112 are selected for writing in the sub-field sf6. However, the 648th to 1080th scanning lines 112 each are selected twice in the period F. The first time is the writing for the sub-field sf5 and the second time is the writing for the sub-field sf6. In the period G, the scanning lines 112 are selected for the sub-field sf7 in a non-interlaced manner in the order from the first to 863rd lines. In addition, in the period H, the scanning lines 112 are sequentially selected in an interlaced manner in the order of the first, 864th, second, 865th, third, 866th, . . . , 217th and 1080th lines and then selected in a non-interlaced manner again in the order from the 218th to 1080th lines. In the above described scanning in the period H, the first to 863rd scanning lines 112 are selected for writing in the sub-field sf8. However, the 864th to 1080th scanning lines 112 each are selected twice in the period H. The first time is the writing for the sub-field sf7 and the second time is the writing for the sub-field sf8. Note that, because negative polarity writing will be specified in the next field, the voltage Vw(−) will be written and held in the liquid crystal element 120 when the converted data Db is "1" or the voltage Vb(−) will be written and held in the liquid crystal element 120 when the converted data Db is "0".

FIG. 15 is a view that shows a voltage P(i, j) of the pixel electrode 118 in the i-th row and j-th column liquid crystal element 120. As shown in the drawing, when positive polarity writing is specified, the voltage P(i, j) is any one of the voltage Vw(+) that makes the liquid crystal element enter an on state or the voltage Vb(+) that makes the liquid crystal element enter an off state in accordance with the data Db when the scanning signal G1 attains an H level and is maintained for the period of each sub-field. In addition, when negative polarity writing is specified, the voltage P(i, j) is any one of the voltage Vw(−) that makes the liquid crystal element 120 enter an on state or the voltage Vb(−) that makes the liquid crystal element 120 enter an off state in accordance with the data Db when the scanning signal Gi attains an H level and is maintained for the period of each sub-field.

Figure 16:
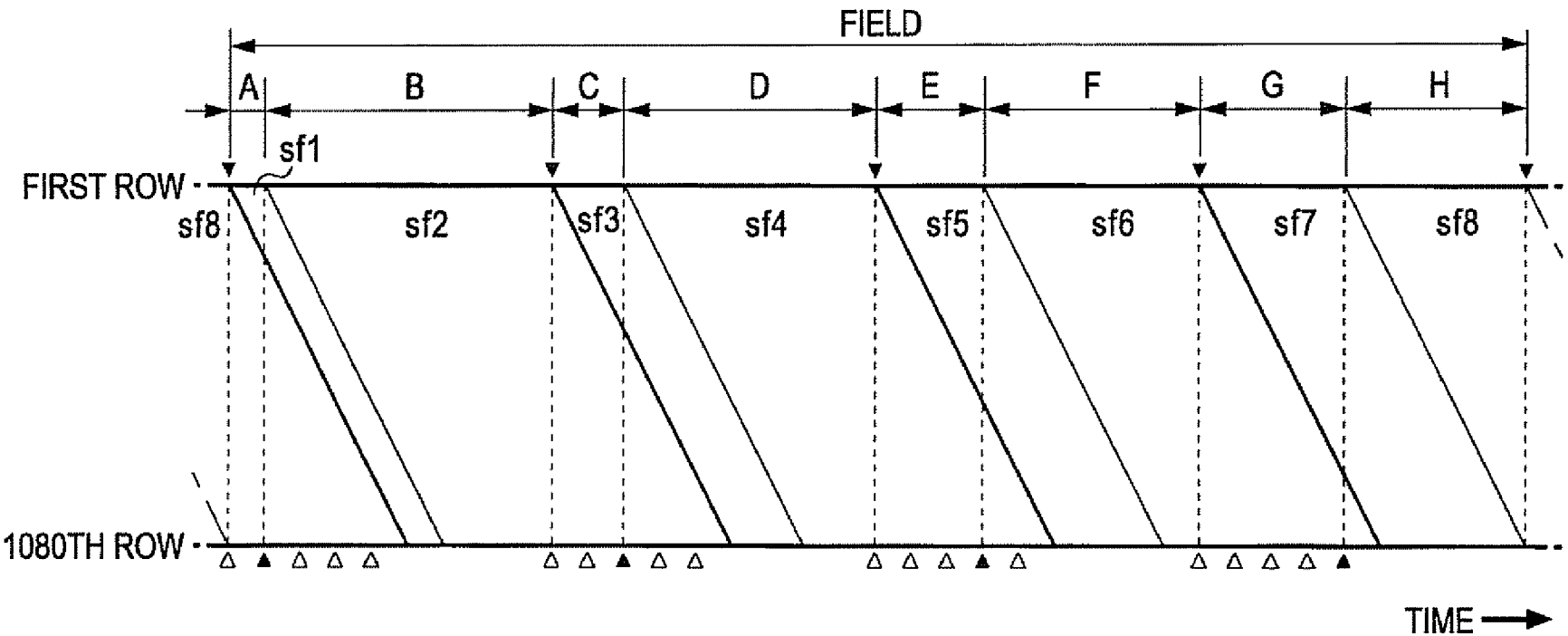
FIG. 16 is a view that shows the progress of writing in each sub-field in the electro-optical device.

FIG. 16 is a view that shows the progress of writing of an on state or an off state for each of the pixels 110 that are located in the first to 1080th scanning lines over the periods A to H. Note that, in the drawing, selection of the scanning lines is shown with small dots; however, because the scanning lines are selected toward the lower side over time, the small dots are shown as solid lines that are continuous to the right lower direction.

Figure 22:
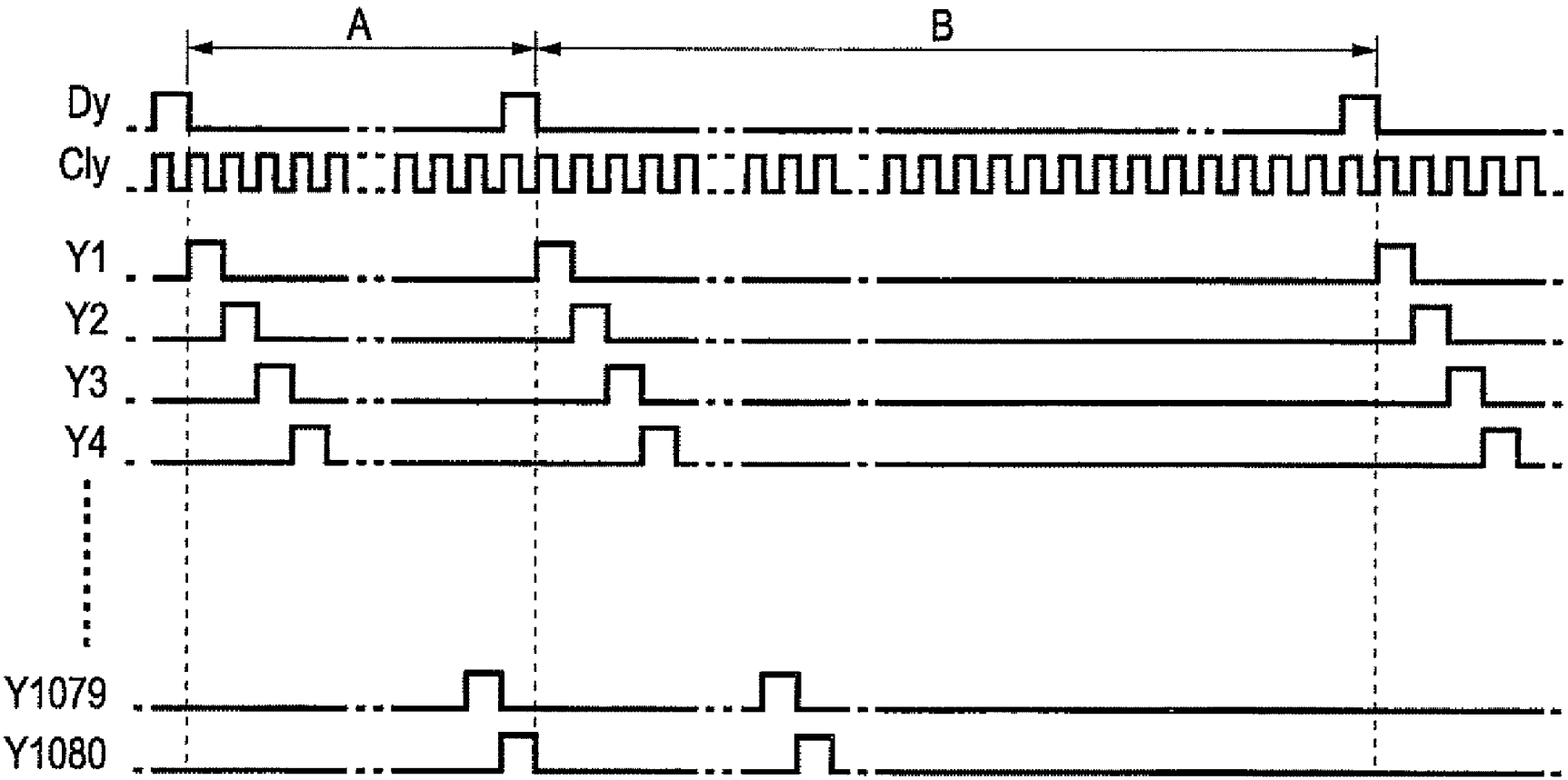
FIG. 22 is a view that shows scanning signals used in an electro-optical device according to a comparative embodiment.
Figure 23:
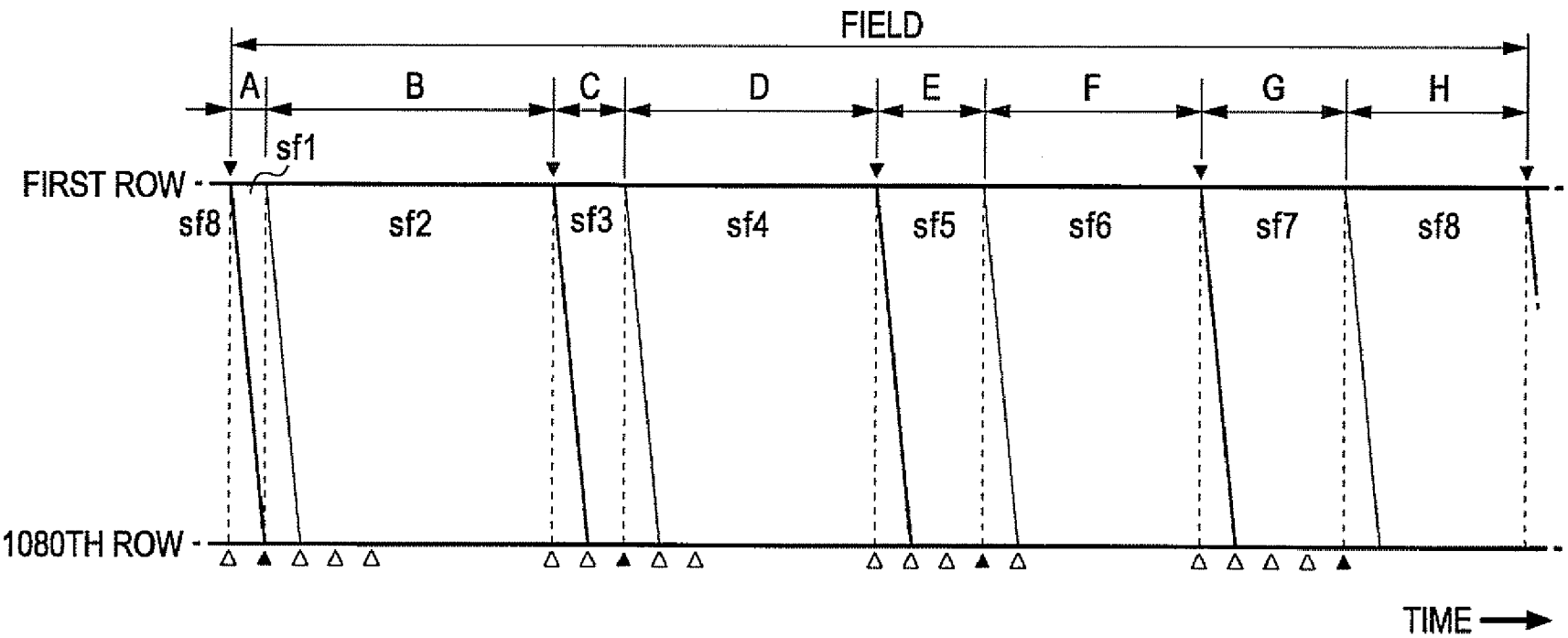
FIG. 23 is a view that shows the progress of writing in each sub-field according to the comparative embodiment.

In the present embodiment, the scanning lines are scanned in an interlaced manner in part of the period of each sub-field. In order to describe the advantage of this configuration, the configuration in which interlaced scanning is not performed will be described with reference to FIG. 22 and FIG. 23. When the scanning lines 112 are sequentially selected from the first to the 1080th for writing of an on state or an off state in each sub-field in a non-interlaced manner, it is necessary that the selection is completed within the period A that corresponds to the shortest sub-field sf1 as shown in FIG. 22 and writing in the sub-fields sf1 to sf8 is made to progress in the order from the first to 1080th lines over the periods A to H as shown in FIG. 23. The time period from time when the shift signal Y1 attains an H level by the transfer of a start pulse Dy to time when the shift signal Y1080 attains an L level is 1080 cycles of the clock signal Cly, so that, when this time period is made to coincide with the period of the sub-field sf1 of which the ratio is "1", the length of a time period of one group is 9720 (=1080×9) cycles of the clock signal Cly.

Thus, in the configuration in which interlaced scanning is not performed, because the high speed operation is required in comparison with the 1944 cycles in the embodiment, sufficient writing time cannot be ensured. In addition, when the number of addressable luminance levels that can be displayed is increased, one field is further divided into multiple sub-fields and the time period of the shortest sub-filed needs to be set further short. However, in the non-interlaced scanning, it is understandable that such setting is also difficult. In contrast, in the present embodiment, as shown in FIG. 16, because writing of an on state or an off state in each of the sub-fields is made to progress for each of the pixels 110 that are located in the first to 1080th scanning lines, it is possible to not only set the sub-field sf1 having the shortest time period shorter than the time period required to sequentially select the scanning lines 112 from the first to 1080th lines but also ensure sufficient writing time.

In addition, according to the present embodiment, because the sub-fields that make the liquid crystal elements enter an on state or an off state are continuous, respectively, even when the response speed due to a change in temperature, or the like, increases when the sub-fields that make the liquid crystal elements enter an on state are made discontinuous, a stepwise change in the reflectance ratio of each of the liquid crystal elements in accordance with the gray-scale levels may be ensured. Furthermore, because the displacement of the barycenter in the period of sub-fields in which the liquid crystal element is in an on state between the adjacent gray-scale levels is small (see FIG. 4), it is possible to appropriately perform gray scale display. In addition, in the present embodiment, because the scanning lines are selected in an interlaced manner in part of the periods B, D, F and H and, as shown in FIG. 16, writing of an on state or an off state in each sub-field is made to progress, it is not necessary to select all the scanning lines 112 from the first to the 1080th lines in the sub-field sf1 of which the length of the time period is the shortest. Thus, restrictions on time to select the scanning lines or time to write a voltage to each of the liquid crystal capacitors may be modulated, and it is easy to cope with reducing the length of the time period of the sub-field sf1 for further multiple gray scales or increasing the scanning speed. Furthermore, the configuration for interlaced selection only adds the start pulse Dys that is output at time intervals of 1944 cycles of the clock signal Cly and the configuration that the switch 40 selects and uses one of the pulses, which are obtained by delaying the start pulse Dys by certain time periods by the delay circuits 41 to 44, the configuration of the entire device is not complex.

Second Embodiment

Figure 17:
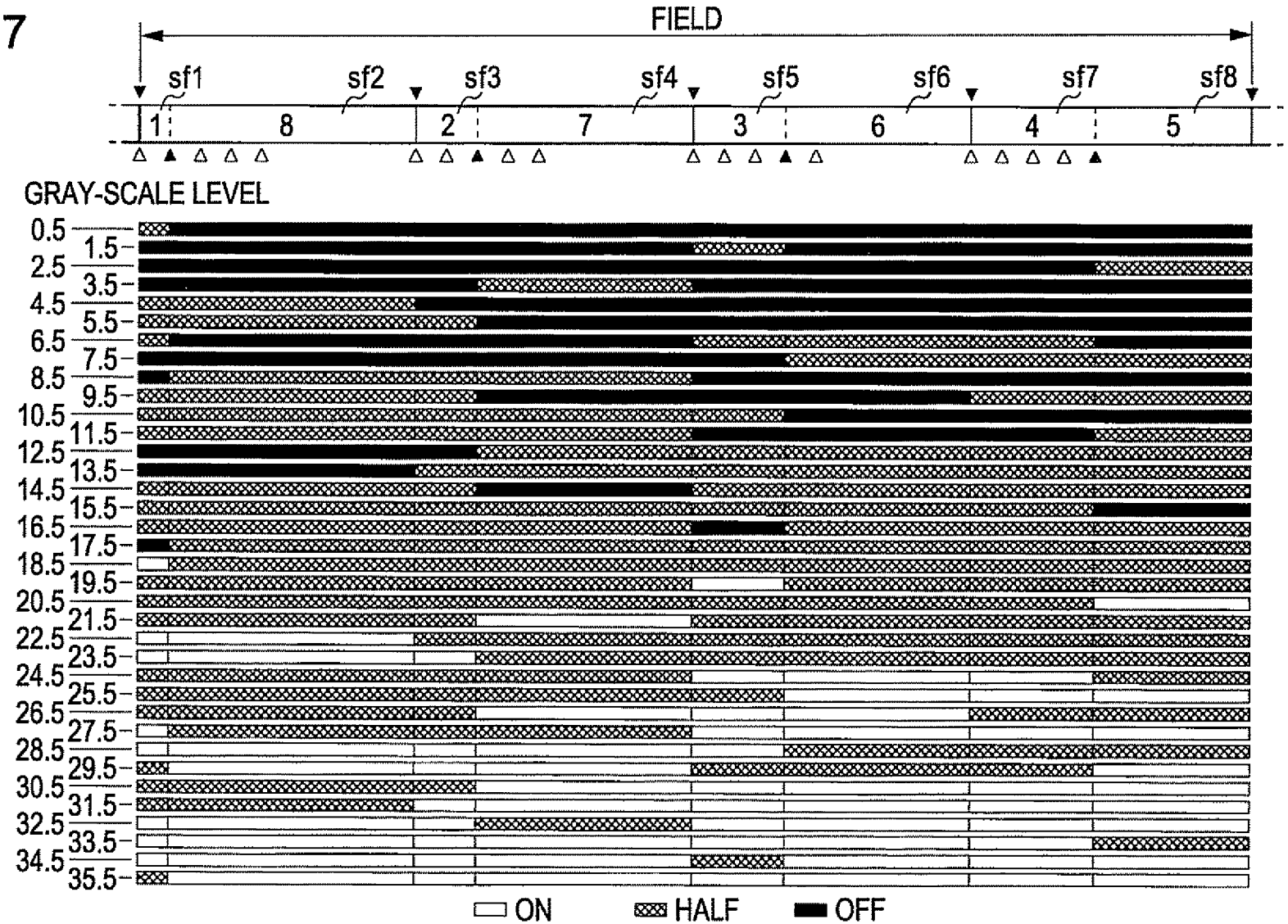
FIG. 17 is a view that shows the grayshade of an electro-optical device according to a second embodiment of the invention.

In the first embodiment, the liquid crystal elements 120 are made to enter any one of an on state or an off state over the sub-fields sf1 to sf8; however, multiple gray scales may be achieved by adding an intermediate (half) voltage in addition to these on state and off state without changing the configuration of the sub-fields. FIG. 17 is a view that shows allocation of an on state, a half state, or an off state to the sub-fields sf1 to sf8 in regard to gray-scale levels in steps of one level from "0.5" to "35.5". When each of the liquid crystal elements 120 is set to a normally black mode, each liquid crystal element 120 tends to appear white color corresponding to an on state when the pixel electrode 118 is applied with the voltage Vw(+) or Vw(−) and tends to appear black color corresponding to an off state when the pixel electrode 118 is applied with the voltage Vb(+) or Vb(−). Thus, when a voltage Vg(+), which is the intermediate voltage between the voltages Vw(+) and Vb(+), is applied to the pixel electrode 118 in the case of positive polarity, or when a voltage Vg(−), which is the intermediate voltage between the voltages Vw(−) and Vb(−), is applied to the pixel electrode 118 in the case of negative polarity, the liquid crystal element 120 tends to appear a brightness that corresponds to gray color having a reflectance ratio of 50%.

As shown in FIG. 17, in the case of the gray-scale level "0.5", a half state is allocated to the sub-field sf1 and an off state is allocated to the other sub-fields. This is because the following reason. That is, the gray-scale level "0.5" is, in short, the case in which the brightness that corresponds to half the gray-scale level "1" shown in FIG. 4 is used. Thus, in regard to the gray-scale level "0.5", when the on state of the sub-field sf1 in the case of the gray-scale level "1" shown in FIG. 4 is replaced by the half state, it is conceivable that, when the time period of a field is regarded as a unit period, the brightness that corresponds to a gray-scale level between the gray-scale levels "0" and "1" may be obtained. The gray-scale levels from "1.5" to "17.5" shown in FIG. 17 are also based on the same concept. For example, because the gray-scale level "11.5" may be regarded as a brightness that corresponds to half the gray-scale level "23", the on states of the sub-fields sf1 to sf4 and sf8 in the gray-scale level "23" shown in FIG. 4 are replaced by the half state. Note that, in regard to the gray-scale levels "18.5" to "35.5", the off states of the gray-scale levels "17.5" to "0.5" are changed to the on states. For example, the gray-scale level "24.5" is obtained by changing the off states of the sub-fields sf5 to sf7 in the gray-scale level "11.5" to the on states.

Thus, in the second embodiment, when the content shown in FIG. 17 is employed in addition to the steps of one level from "0" to "36" shown in FIG. 4 in the first embodiment, the steps are further fragmented to the steps of "0.5". As a result, it is possible to substantially double the multiple gray scales. Note that, in regard to conversion using the conversion table 30 in the second embodiment, the content corresponding to FIG. 17 needs to be added to FIG. 5, that is, specifically, the gray-scale levels are set in steps of "0.5" and it is necessary to convert the data into the data Db that specify, to each of the gray-scale levels, "1" of an on state, "0" of an off state and "0.5" of a half state; however, the details thereof are not shown in the drawing. In addition, the data line driving circuit 140 is configured to, when the data Db is "0.5" that corresponds to the half state, supply each of the data lines 114 with a data signal of the voltage Vg(+) that is converted from the data Db when positive polarity writing is specified or with a data signal of the voltage Vg(−) that is converted from the data Db when negative polarity writing is specified.

Figure 18:
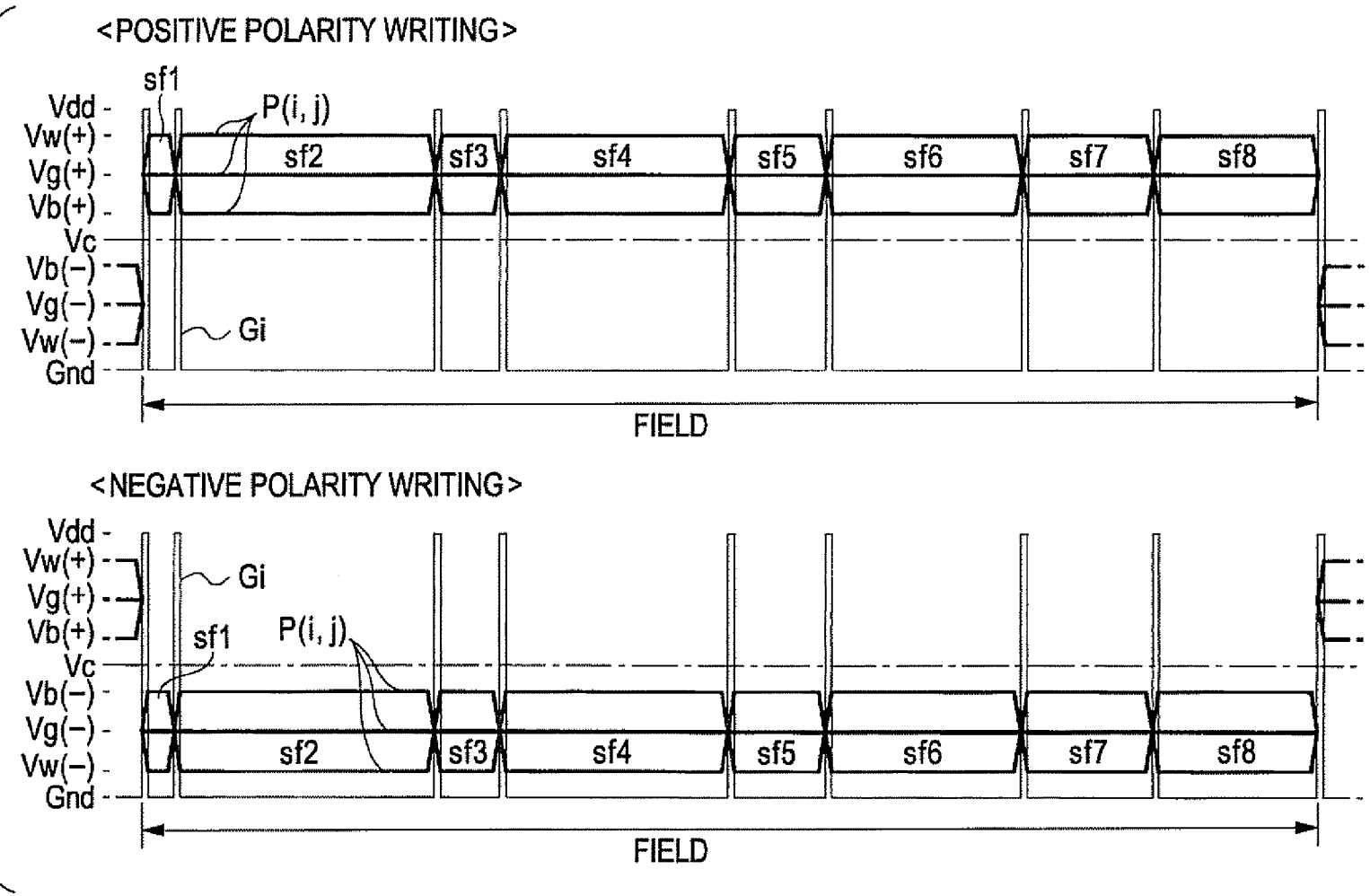
FIG. 18 is a view that shows writing of on or off in each sub-field in the electro-optical device.

FIG. 18 is a view that shows a voltage P(i, j) of the pixel electrode 118 in the i-th row and j-th column liquid crystal element 120. As shown in the drawing, when positive polarity writing is specified, the voltage P(i, j) is any one of the voltage Vw(+) that makes the liquid crystal element enter an on state, the voltage Vg(+) that makes the liquid crystal element enter a half state or the voltage Vb(+) that makes the liquid crystal element enter an off state in accordance with the data Db when the scanning line Gi attains an H level, while, on the other hand, when negative polarity writing is specified, the voltage P(i, j) is any one of the voltage Vw(−), the voltage Vg(−) or the voltage Vb(−) in accordance with the data Db when the scanning signal Gi attains an H level, and the voltages are held for the period of each sub-field.

In this manner, according to the second embodiment, it is possible to achieve multiple gray scales without changing the configuration of the sub-fields. Furthermore, because the sub-fields that make the liquid crystal elements enter an on state, a half state or an off state are respectively continuous, it is possible to suppress the situation in which a desired gray scale cannot be obtained because of discontinuous sub-fields. Note that allocation of a half state may employ various manners other than that shown in FIG. 17. Here, a half state having a reflectance ratio of 50% is used as an intermediate voltage; however, for example, the intermediate voltage may, for example, employ two types, that is, the reflectance ratios of 33% and 66%, or employ three types, that is, the reflectance ratios of 25%, 50% and 75%, or the like, to achieve further multiple gray scales.

Application and Alternative Embodiments

In the above described embodiments, the enable signal Enb1 is supplied to one of input ends of each odd-numbered AND circuit 134 and the enable signal Enb2 is supplied to one of input ends of each even-numbered AND circuit 134. The reason why the above configuration is employed in the embodiments is as follows. That is, by sequentially shifting the start pulse Dy using the shift register 132, the odd-numbered and even-numbered shift signals become an H level pulse at the same time. The pulse is taken out by the enable signal Enb1 in each odd-numbered line and is taken out by the enable signal Enb2 in each even-numbered line to thereby make the scanning signal be not at an H level overlappingly.

Thus, in the above embodiments, shift signals of which H levels are overlapped are configured so as not to overlap between in the odd-numbered lines and in the even-numbered lines. Then, shift signals, of which H levels are overlapped, may be taken out with first to fourth series enable signals to obtain scanning signals. Here, the first series indicates lines of which remainder is "1" when the line numbers of the first to 1080th lines are divided by "4", and, specifically, indicates the lines corresponding to the first, fifth, ninth, . . . , 1077th scanning lines 112. Similarly, the second, third and fourth series indicate lines of which remainders are respectively "2", "3", "0" when the line numbers of the first to 1080th lines are divided by "4". Specifically, the second series indicates the lines corresponding to the second, sixth, tenth, . . . , 1078th scanning lines 112. The third series indicates the lines corresponding to the third, seventh, eleventh, . . . , 1079th scanning lines 112. The fourth series indicates the lines corresponding to the fourth, eighth, twelfth, and . . . , 1080th scanning lines 112. In this manner, when the first to fourth series enable signals are used, it is possible to output the scanning signals, of which H levels are not overlapped, from four shift signals of which H levels are overlapped. Therefore, it is possible to make writing of an on or off voltage in each sub-field progress as shown, for example, in FIG. 19.

Figure 19:
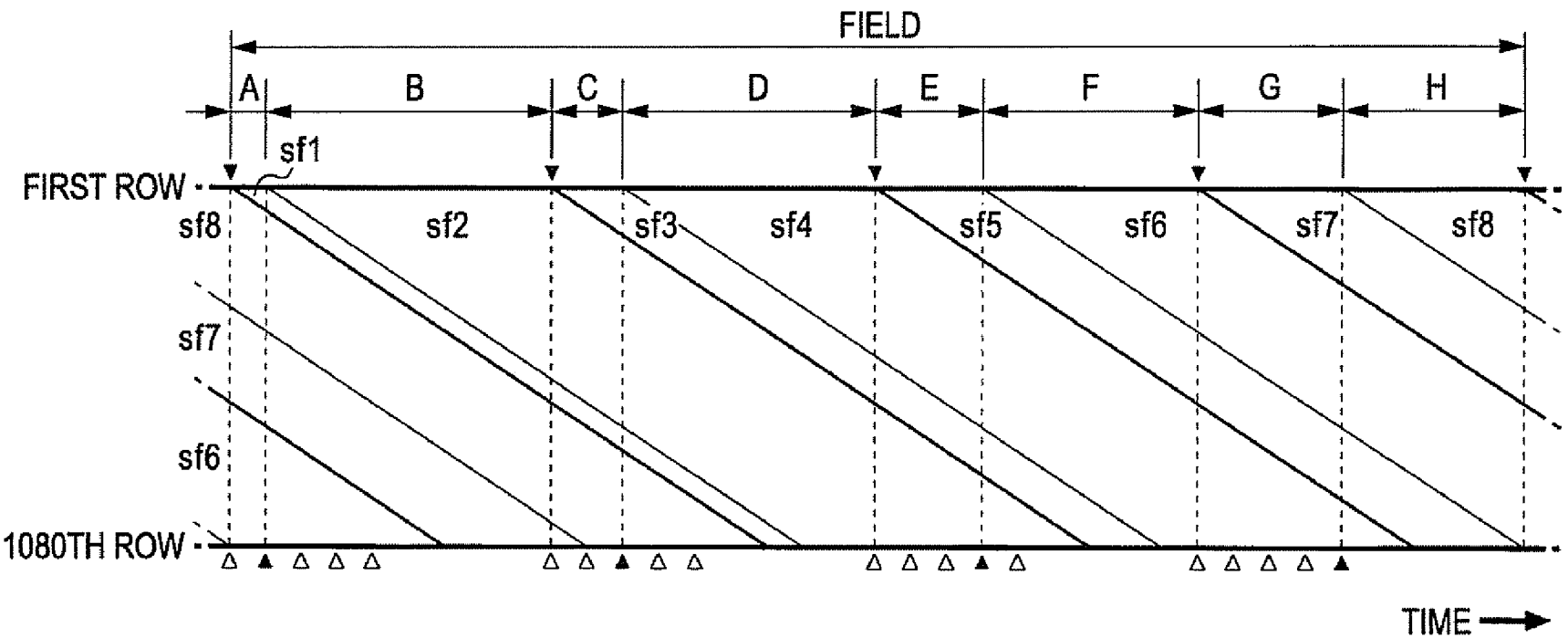
FIG. 19 is a view that shows the progress of writing in each sub-field of an application example according to the invention.

Note that the time period from time when the shift signal Y1 attains an H level by the transfer of a start pulse Dy to time when the scanning line Y1080 attains an L level is 1080 cycles of the clock signal Cly; however, in an example shown in FIG. 19, because the above time period is set to a ratio of "15", the length of the time period of one group is 648 (=1080×9/15) cycles of the clock signal Cly. Thus, in the example shown in the drawing, the start pulse Dys is output at time intervals of 648 cycles of the clock signal Cly and is used to select the scanning lines for the odd-numbered sub-field sf1, and, when this start pulse Dys is delayed by 71, 143, 215 or 287 cycle and input to the first stage of the shift register 132 as the start pulse Dy, the start pulse Dy may be used to select the scanning lines for the even-numbered sub-field sf2, sf4, sf6 or sf8, respectively.

Figure 20:
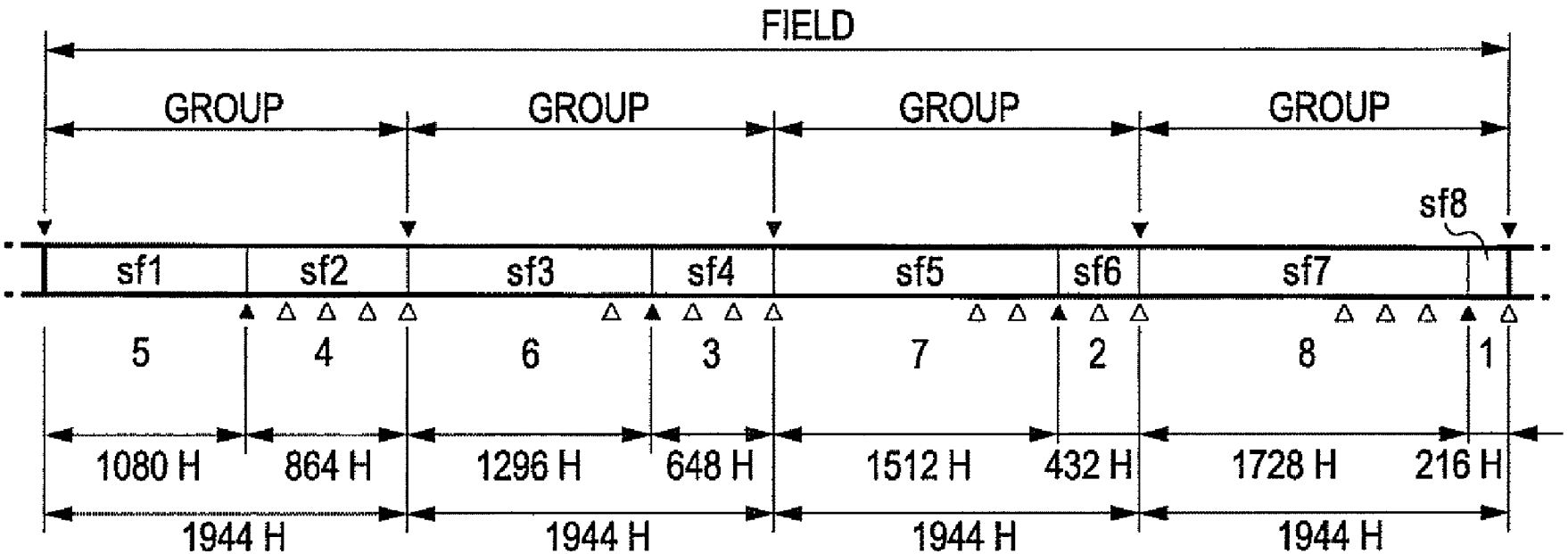
FIG. 20 is a view that shows another configuration of a field according to the invention.

In the above embodiments, each of the boundaries among the group of the sub-fields sf1 and sf2, the group of the sub-fields sf3 and sf4, the group of the sub-fields sf5 and sf6 and the group of the sub-fields sf7 and sf8 are configured to be delayed at an equal pitch as shown in FIG. 3; however, as shown in FIG. 20, the boundaries may be configured to be advanced in terms of time conversely. In FIG. 20, when sub-fields that constitute one field are sequentially termed as the sub-field sf1 to sf8, the on state or off state of each of the liquid crystal elements may be specified in such a manner that the sub-fields sf1 to sf8 shown in FIG. 20 are replaced by the sub-fields sf7, sf8, sf5, sf6, sf3, sf4, sf1 and sf2 shown in FIG. 3, that is, replaced by the sub-fields having the same lengths of time periods. Furthermore, in the embodiments, p is set to "4", and one field is equally divided into four groups and then one group is divided into an odd-numbered sub-field and an even-numbered sub-field, while each boundary between the odd-numbered sub-field and the even-numbered sub-field is delayed or advanced at an equal pitch; however, one field may be divided into five or more groups to thereby increase the number of addressable luminance levels that can be displayed, or one field may be divided into two or three groups. That is, p may be an integer that is equal to or more than two.

In addition, in the above described embodiments, the liquid crystal element 120 is described as a normally black mode; however, it may be a normally white mode that performs white display in a state of no voltage being applied. Furthermore, color display may be performed with dots, each of which is constituted of three pixels, that is, R (red), G (green) and B (blue). In addition, the liquid crystal element is not limited to a reflective type, but it may be of a transmissive type or of a transflective type that is intermediate between the reflective type and the transmissive type. In addition, the display element is not limited to a liquid crystal element, but the display element may be applied to, for example, devices that use an EL (Electronic Luminescence) element, an electron emission element, an electrophoretic element or a digital mirror element, or a plasma display.

Electronic Apparatus

Figure 21:
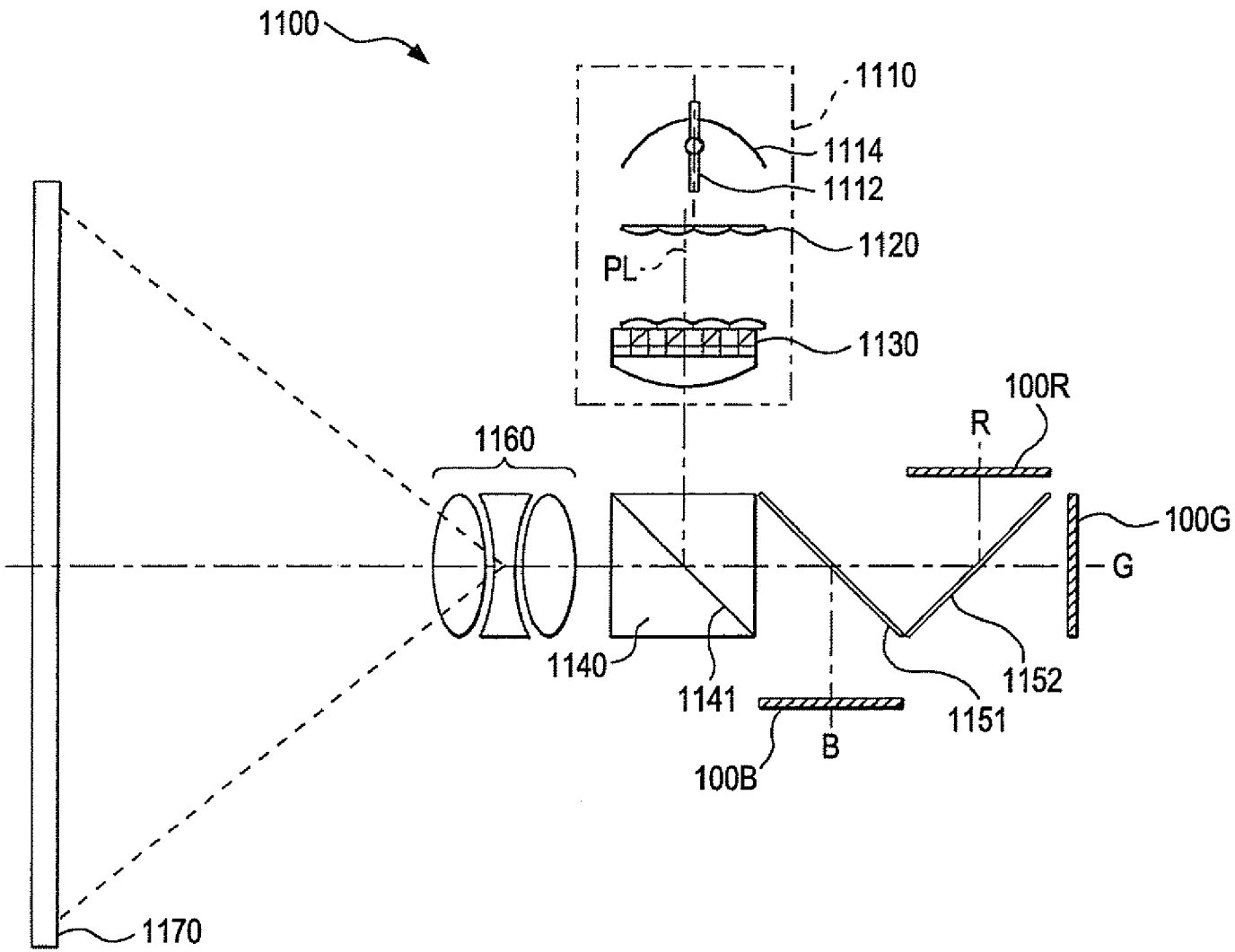
FIG. 21 is a view that shows the configuration of a projector that uses the electro-optical device according to the embodiments.

Next, as an example of an electronic apparatus that uses the electro-optical device according to the above described embodiments, a projector that uses the above described electro-optical device 1 as a light bulb will be described. FIG. 21 is a plan view of the configuration of the projector. As shown in the drawing, the projector 1100 is of a three panel type in which the three reflective electro-optical devices 1 according to the embodiments are respectively used for each of R (red), G (green) and B (blue). The projector 1100 includes a polarizer lighting device 1110 that is arranged along a system optical axis PL. In the polarizer lighting device 1110, light emitted from a lamp 1112 forms substantially parallel beams of light by being reflected on a reflector 1114 and enters a first integrator lens 1120. Owing to this first integrator lens 1120, light emitted from the lamp 1112 is split into a plurality of intermediate beams of light. These intermediate beams of light are converted into polarized beams of light (s polarized beams of light) of one kind, having substantially the same polarization direction by a polarization conversion element 1130 that includes a second integrator lens on the light incidence side, and then exits from the polarizer lighting device 1110.

The s polarized beams of light that exits from the polarizer lighting device 1110 are reflected on an s polarization beam reflection plane 1141 of the polarization beam splitter 1140. Among the reflected beams of light, beams of blue light (B) are reflected on a blue light reflection layer of the dichroic mirror 1151 and modulated by the reflective light bulb 100B. In addition, among beams of light that pass through the blue light reflection layer of the dichroic mirror 1151, beams of red light (R) are reflected on a red light reflection layer of the dichroic mirror 1152 and modulated by the reflective light bulb 100R. On the other hand, among beams of light that pass through the blue light reflection layer of the dichroic mirror 1151, beams of green light (G) pass through the red light reflection layer of the dichroic mirror 1152 and modulated by the reflective light bulb 100G. Here, the light bulbs 100R, 100G and 100B are the same as the display circuit 100 in the embodiments described above, and are driven by supplied data signals corresponding to colors of R, G and B, respectively. That is, in the projector 1100, the three electro-optical devices 1 that include the display circuits 100 are provided in correspondence with colors of R, G and B, and are driven with sub-fields in accordance with display data corresponding to colors of R, G and B.

Red, green and blue beams of light that are modulated by the light bulbs 100R, 100G, 100B are sequentially composed by the dichroic mirrors 1152, 1151 and the polarization beam splitter 1140 and, after that, projected onto a screen 1170 by the projection optical system 1160. Note that, because beams of light corresponding to primary colors of R, G and B respectively enter the light bulbs 100R, 100B and 100G by the dichroic mirrors 1151 and 1152, no color filters are required.

The electronic apparatus may be, in addition to the projector described with reference to FIG. 21, a television, a viewfinder type or direct view type video tape recorder, a car navigation system, a pager, a personal organizer, an electronic calculator, a word processor, a workstation, a video telephone, a POS terminal, a digital still camera, a cellular phone, or devices provided with a touch panel. Then, needless to say, the electro-optical device according to the aspects of the invention may be applied to these various electronic apparatuses.

The entire disclosure of Japanese Patent Application No. 2007-126551, filed May 11, 2007 is expressly incorporated by reference herein.

What is claimed is:

1. A driving circuit of an electro-optical device that includes a plurality of scanning lines, a plurality of data lines, and a plurality of pixels arranged at positions corresponding to intersections of the scanning lines and the data lines, comprising:

a scanning line driving circuit that drives the plurality of scanning lines; and a data line driving circuit that drives the plurality of data lines, wherein:

one field is divided into p (p is an integer that is equal to or more than two) groups and each group is divided into two sub-fields, the p groups each are set to have the length of a time period that is equal to one another, the 2p sub-fields that constitute the one field are set to different lengths of time periods in such a manner that a boundary between two sub-fields of each group is shifted by a predetermined interval compared to the boundary between the two sub-fields of the preceding group, the total length of time periods of sub-fields that are in an on state during the field constituted by the sub-fields is set in accordance with a gray-scale level that is specified to each of the pixels during the field, different gray scale values are expressed by turning on a single sub-field or n (n is an integer that is equal to two or more and that is equal to or less than 2p) sub-fields that are adjacent to each other, the scanning line driving circuit includes:

a shift register that has stages corresponding to the plurality of scanning lines and that sequentially delays a pulse, which is supplied at a time interval corresponding to each of the sub-fields, over the stages in accordance with a clock signal, and logic circuits each provided for the plurality of scanning lines, the logic circuits performing a logical operation on pulses that are overlappingly output from the stages of the shift register to supply non-overlapping scanning signals the corresponding scanning line to indicate selection of the scanning lines, and when one of the scanning lines is selected, the data line driving circuit supplies a data signal, which corresponding to a gray scale of the pixel corresponding to the selected one of the scanning lines and one of the data lines, to the one of the data lines in accordance with an on state or an off state that is set to a sub-field corresponding to the selection.

2. The driving circuit of the electro-optical device according to claim 1, wherein the number of pulses that are overlappingly output from the stages of the shift register is up to "2", and wherein the logic circuit provided in each line outputs a logical multiplication signal of an enable signal and the shift register, and wherein different enable signals are output between in the odd-numbered lines and in the even-numbered lines.

3. The driving circuit of the electro-optical device according to claim 1, wherein the boundary between the two sub-fields that constitute each group is set to a point that is sequentially shifted to the following side along time axis by a predetermined interval for the p groups, and wherein the scanning line driving circuit includes a circuit that supplies a pulse output at time intervals of the length of a time period of one of the groups to the shift register as it is in order to select scanning lines in a preceding sub-field in terms of time in the one of the groups, and that delays a pulse output at time intervals of the length of the time period of the one of the groups in accordance with the length of a time period of the preceding sub-field in terms of time in the one of the groups and then supplies the delayed pulse to the shift register in order to select scanning lines in a following sub-field in terms of time.

4. The driving circuit of the electro-optical device according to claim 1, wherein each of the pixels includes a liquid crystal element that appears any one of white color or black color when in the on state and that appears the other one of white color or black color when in the off state, and wherein among the sub-fields, the length of a time period of the shortest sub-field is set shorter than saturation response time that takes until the reflectance ratio or transmittance ratio of the liquid crystal element is saturated when a voltage for the on state is applied to the liquid crystal element.

5. The driving circuit of the electro-optical device according to claim 1, wherein the number of gray-scale levels in which, when viewed in one or adjacent fields, the sub-fields in which the liquid crystal elements are made to enter an on state or an off state are continuous, respectively, is equal to or more than half the number of addressable luminance levels that can be displayed in the pixels, wherein the driving circuit further includes a conversion table that converts display data, which specify a gray-scale level of each pixel, into data that specify an on state or an off state that is set in units of sub-field, and wherein the data line driving circuit outputs a data signal on the basis of the converted data.

6. The driving circuit of the electro-optical device according to claim 1, wherein, in the sub-field, each of the pixels is controlled to any one of the on state, the off state or an intermediate state that falls between the on state and the off state.

7. A method of driving an electro-optical device that includes a plurality of scanning lines, a plurality of data lines, and a plurality of pixels arranged at positions corresponding to intersections of the scanning lines and the data lines, the method comprising:

dividing one field into p (p is an integer that is equal to or more than two) groups and dividing each group into two sub-fields;

setting each of the p groups to have the length of a time period that is equal to one another;

setting the 2p sub-fields that constitute the one field to be different lengths of time periods in such a manner that a boundary between two sub-fields of each group is shifted by a predetermined interval compared to the boundary between the two sub-fields of the preceding group;

setting the total length of time periods of sub-fields that are in an on state during the field constituted by the sub-fields in accordance with a gray-scale level that is specified to each of the pixels during the field;

expressing different gray scale values by turning on a single sub-field or n (n is an integer that is equal to two or more and that is equal to or less than 2p) sub-fields that are adjacent to each other;

supplying a shift register having stages, which are provided in correspondence with the plurality of scanning lines, with a pulse at a time interval corresponding to each of the sub-fields to sequentially delay the pulse over the stages in accordance with a clock signal;

supplying the logic circuits, which are provided respectively for the plurality of scanning lines, with a pulse that is overlappingly output from the stages of the shift register as a scanning signal that indicates selection so as not to overlap each other among the plurality of lines through logical operation; and when one of the scanning lines is selected, supplying a data signal, which corresponding to a gray scale of the pixel corresponding to the selected one of the scanning lines and one of the data lines, to the one of the data lines in accordance with an on state or an off state that is set to a sub-field corresponding to the selection.

8. An electro-optical device comprising:

a plurality of scanning lines;

a plurality of data lines;

a plurality of pixels arranged at positions corresponding to intersections of the scanning lines and the data lines;

a scanning line driving circuit that drives the plurality of scanning lines; and a data line driving circuit that drives the plurality of data lines, wherein:

one field is divided into p (p is an integer that is equal to or more than two) groups and each group is divided into two sub-fields, the p groups each are set to have the length of a time period that is equal to one another, the 2p sub-fields that constitute the one field are set to different lengths of time periods in such a manner that a boundary between two sub-fields of each group is shifted by a predetermined interval compared to the boundary between the two sub-fields of the preceding group, the total length of time periods of sub-fields that are in an on state during the field constituted by the sub-fields is set in accordance with a gray-scale level that is specified to each of the pixels during the field, different gray scale values are expressed by turning on a single sub-field or n (n is an integer that is equal to two or more and that is equal to or less than 2p) sub-fields that are adjacent to each other, the scanning line driving circuit includes:

a shift register that has stages corresponding to the plurality of scanning lines and that sequentially delays a pulse, which is supplied at a time interval corresponding to each of the sub-fields, over the stages in accordance with a clock signal, and logic circuits each provided for the plurality of scanning lines, the logic circuits performing a logical operation on pulses that are overlappingly output from the stages of the shift register to supply non-overlapping scanning signals the corresponding scanning line to indicate selection of the scanning lines, and when one of the scanning lines is selected, the data line driving circuit supplies a data signal, which corresponding to a gray scale of the pixel corresponding to the selected one of the scanning lines and one of the data lines, to the one of the data lines in accordance with an on state or an off state that is set to a sub-field corresponding to the selection.

9. An electronic apparatus comprising the electro-optical device according to claim 8.

* * * * *